US006764363B2

(12) United States Patent
Rosen

(10) Patent No.: US 6,764,363 B2
(45) Date of Patent: Jul. 20, 2004

(54) UPRIGHT HUMAN FLOATATION APPARATUS AND PROPULSION MECHANISM THEREFOR

(75) Inventor: Yoav Rosen, Newton, MA (US)

(73) Assignee: Wave Walk, Inc., Newton, MA (US)

( * ) Notice: Subject to any disclaimer, the term of this patent is extended or adjusted under 35 U.S.C. 154(b) by 0 days.

(21) Appl. No.: 10/201,066

(22) Filed: Jul. 22, 2002

(65) Prior Publication Data

US 2003/0017769 A1 Jan. 23, 2003

Related U.S. Application Data

(60) Provisional application No. 60/307,258, filed on Jul. 23, 2001, provisional application No. 60/307,259, filed on Jul. 23, 2001, provisional application No. 60/307,260, filed on Jul. 23, 2001, provisional application No. 60/307,270, filed on Jul. 23, 2001, and provisional application No. 60/307,277, filed on Jul. 23, 2001.

(51) Int. Cl.[7] ..... B63B 35/83
(52) U.S. Cl. ..... 441/77
(58) Field of Search ..... 440/13–21, 24, 440/25; 441/65, 76, 77

(56) References Cited

U.S. PATENT DOCUMENTS

| | | | | |
|---|---|---|---|---|
| 22,457 A | | 12/1858 | Rowlands | |
| 216,234 A | | 6/1879 | Soule | |
| 579,695 A | | 3/1897 | Carmina-Morreale | |
| 1,006,118 A | * | 10/1911 | Napier | 440/19 |
| 1,384,354 A | * | 7/1921 | Sheldon | 441/77 |
| 1,443,133 A | | 1/1923 | Kelly | |
| 1,475,031 A | | 11/1923 | Sheldon | |
| 1,487,368 A | | 3/1924 | Berka | |
| 1,586,458 A | * | 5/1926 | Newby | 114/283 |
| 1,692,055 A | | 11/1928 | Sheldon | |
| 1,719,059 A | | 7/1929 | Krupka et al. | |
| 2,153,939 A | | 4/1939 | Schaupp | |
| 2,694,209 A | | 11/1954 | Lippincott | |
| 3,084,356 A | | 4/1963 | Wheat | |
| 3,087,455 A | * | 4/1963 | Collier | 440/19 |
| 3,112,504 A | * | 12/1963 | Carlton | 441/77 |
| 3,121,892 A | | 2/1964 | Plumlee | |
| 3,194,206 A | | 7/1965 | Anderson | |
| 3,256,850 A | | 6/1966 | Bramson | |
| 3,369,517 A | | 2/1968 | Rosenthal | |
| 3,605,676 A | | 9/1971 | Spargenberg | |

(List continued on next page.)

FOREIGN PATENT DOCUMENTS

| | | | | |
|---|---|---|---|---|
| DE | 2249316 | * | 10/1972 | 114/315 |
| DE | 3431659 A1 | * | 3/1986 | B63H/16/18 |
| DE | 3441589 A1 | * | 5/1986 | A63B/35/00 |
| DE | 3902367 A1 | * | 8/1990 | B63H/11/06 |
| GB | 2212467 A | * | 7/1989 | B63H/1/30 |
| NL | 8401176 | * | 11/1985 | 441/64 |

*Primary Examiner*—S. Joseph Morano
*Assistant Examiner*—Ajay Vasudeva
(74) *Attorney, Agent, or Firm*—Inna Landsman

(57) ABSTRACT

An apparatus for the purpose of floatation and transportation on water comprises a pair of buoyant wing-shaped floats and foot wells in the floats designed to be under the center of buoyancy of each float. The apparatus may further comprise a tether attached to each float at the user's ankle height. Accessories may be attached to one or more floats. The invention further provides a number of propulsion mechanisms, one of which comprises a support structure, a buoyant flap articulated to the support member by an articulation having an axis of rotation that is both within 45 degrees of horizontal and substantially perpendicular to the direction of travel, said flap being movable substantially in rotation about said axis, said rotation being in a semicylindrical space behind said axis, said space being away from said direction of travel. Additional novel features of the apparatus and propulsion mechanism are discussed herein.

3 Claims, 15 Drawing Sheets

U.S. PATENT DOCUMENTS 3,609,782 A * 10/1971 Mabuchi ..... 441/76
3,621,500 A 11/1971 Senghas
3,714,921 A * 2/1973 Gibson ..... 441/64
3,757,729 A * 9/1973 Golden ..... 440/19
3,874,319 A * 4/1975 Martin et al. ..... 440/27
3,970,031 A 7/1976 Vrana
4,034,430 A * 7/1977 Joyce ..... 441/77
4,117,562 A 10/1978 Schaumann
4,157,597 A * 6/1979 Trebnick ..... 441/76
4,261,069 A 4/1981 Schaumann
4,353,703 A * 10/1982 d'Elloy ..... 440/21
4,698,039 A 10/1987 Watson
4,952,184 A 8/1990 Graziano
5,080,621 A 1/1992 Nayes
5,120,249 A 6/1992 Fonda
5,127,855 A 7/1992 Heywood
5,192,237 A 3/1993 Pegoraro
5,236,381 A * 8/1993 Keogh ..... 441/77
5,421,759 A 6/1995 Morin
5,462,466 A * 10/1995 Hull et al. ..... 441/76
5,593,334 A 1/1997 Thayer
5,697,822 A 12/1997 Souter
6,468,118 B1 * 10/2002 Chen ..... 440/21

* cited by examiner

UPRIGHT HUMAN FLOATATION APPARATUS AND PROPULSION MECHANISM THEREFOR

CROSS-REFERENCE TO RELATED APPLICATIONS

This non-provisional application claims the benefit of U.S. Provisional Patent Applications Ser. Nos. 60/307,258; 60/307,259; 60/307,260; 60/307,270; and 60/307,277, all filed Jul. 23, 2001.

STATEMENT REGARDING FEDERALLY SPONSORED RESEARCH OR DEVELOPMENT

Not applicable

REFERENCE TO COMPACT DISK APPENDIX

Not applicable

BACKGROUND OF THE INVENTION

The present invention generally relates to the field of aquatic floatation and transportation systems. More particularly, the invention relates to a foot-wearable human floatation apparatus used primarily for water-walking or water-skating, and a propulsion mechanism therefor.

Walking on water, like flying, has been considered an interesting mode of transportation for centuries, if not millennia. Prior attempts at creating a foot-worn floatation/propulsion system have yet to produce a water-walking apparatus that enables a human to take near-normal walking steps with confidence.

The act of walking, on land or on water, can be broken down into a sequence of coordinated basic movement pairs (each pair comprising a left leg movement and a right leg movement). There are four basic movements: Forward, an actual forward movement of the first leg and foot; Backwards, the backwards push against the resistance of the ground during which the second foot does not actually move; Up, the lifting the first leg off the ground or un-weighting of the leg during skating; and Down, applying one's weight on the first leg. The act of walking naturally requires the smooth transition from one action to the next, and from one leg to the next. Any water-walking apparatus should allow for all four movements in the normal sequence and with the natural timing a human has learned when walking on land. A key consideration in walking on any medium is to emulate the assumed "100%" friction typically found when applying the Backwards movement on land. Humans slip and fall when friction is reduced during that portion of the walking cycle. In addition, a water-walking apparatus should allow a user to "step around" a turn as a way to change directions while providing the user a feeling of stability at least somewhat similar to the stability found on solid ground. Thus, a successful water-walking apparatus should limit pitch, roll, and side-to-side motions transmitted from the float to the user without constraining the natural walking up-down, front-back, and yawing motions transmitted from the user to the float.

Skating is different than walking in several ways. Skating is a series of movements optimized for low foot-to-support medium friction situations (ice, roller blades, water), where sliding a foot across the support medium will not completely halt forward progress. Because of the low friction, the Up movement doesn't necessarily imply lifting the foot —a simple easing of the pressure to reduce the (normal force generated) frictional resistance, as in Nordic skiing, is often adequate. Second, skating typically involves a gliding movement; weight is carried on the forward leg while the back leg "pushes off". The person using a skating apparatus lifts the foot that has just finished the Backwards, power movement and lets himself be carried forward by momentum, weight on the forward leg. Depending on the desired speed, the user either continues the one leg glide, brings the rearward foot parallel with the gliding foot and performs a two footed glide, or brings the rearward foot to the forward position in anticipation of the next pushing movement. Note that the skater can alternate the roles of the left and right legs (the normal skating action) or repeatedly use only one leg as the pushing leg (as in powering a scooter).

A typical prior water walking apparatus comprises two elongated floats and some sort of variable resistance propulsion mechanism, typically comprising a multitude of either small rotatable flaps or fixed, rearward facing cups, pouches, or scoops. The typical prior float is generally flat bottomed and straight sided and the typical prior propulsion mechanism does not provide maximum resistance against the water at the point in the walking cycle when it is needed; specifically, the maximum resistance is needed at the beginning of the Backwards (power) movement. Prior propulsion systems either require the user to wait to take each step or allow backwards slippage. For example, U.S. Pat. No. 4,698,039 teaches an apparatus having a pair of symmetric floats, these floats being generally rectangular in cross-section and having a flat bottom over most of their length. Additionally, the '039 patent teaches the use of a series of rotatable flaps with vertical axes spaced along either side of a central keel. The flaps move into their high resistance position only by the rearward slippage at the beginning of each step. Further, each flap is "shadowed" by the flap next in line, greatly reducing their propulsive power. Another attempt to provide a propulsion system with rotatable flaps with vertical axes is described in U.S. Pat. Nos. 4,261,069 and 4,117,562, both by Schaumann. In the '069 patent there are two flaps in series in a tunnel like chamber, completely obviating the functionality of the front flap for pushing backwards against the water. The overall float shape in both these patents is again generally an elongated rectangle. The '069 patent is notable in use of a resilient stop that both prevents the flap from opening beyond the desired point and provides a small push back toward the closed condition. However, the resilient stop only provides an initial push, the energy of which is quickly absorbed by the resistance of the water. Two examples of "horizontal" (viz., having a horizontal axis) flaps or pouches are provided by U.S. Pat. Nos. 5,593,334 and 5,697,822. Again, the linear series of small pouches or flaps are too small to be effective and are self-obviating because of shadowing, and again the float shape is generally conducive to instability.

Some prior devices include a tethering mechanism to keep the floats from separating. Many of these mechanisms are overly constraining—that is, rather than just preventing excessive transverse separation, they instead prevent the user's feet from moving in at least some of the degrees of freedom possible on land. Typically, the tether mechanism, if present, either inhibits a full and natural stride (i.e., the length of a step), introduces friction into what is normally a frictionless forward leg movement, prevents the redirection of a forward stride (yaw) (as is needed for turning), or inhibits the required Up and Down leg movements. For example, the '069 patent includes an intertwined cable tether whose claimed function is explicitly to eliminate virtually all sideways motions, to limit the length of the stride, and to ensure the engagement of a tongue-and-groove mechanism for eliminating up-down motions. Another example of an overly constraining tethering mechanism is shown in U.S. Pat. No. 3,121,892 in which the two floats (actually "skis" in that each float is a thin, flat board similar to conventional water skis) are joined by what amounts to either a single or a double linear bearing that constrains the relative motion between the skis.

It is therefore an object of this invention to provide a water-walking apparatus in which the maximum resistance to the water is achieved at the beginning of, and maintained throughout, the Backward pushing movement. Other objectives can include providing an apparatus in which the user achieves a near land-like stability, which allows the user to transition from deep to shallow water and thence to solid surfaces (land, ice, etc.) while walking, and/or an apparatus with a foot attachment method that allows the user all normal walking motions while providing a quick release for safety. These and other objectives are met through the various embodiments discussed below.

BRIEF SUMMARY OF THE INVENTION

The present invention relates to a foot-wearable apparatus for human floatation and transportation on water in a direction of travel. In one embodiment, the apparatus comprises a first buoyant float and a second buoyant float, each of said first buoyant float and said second buoyant float comprising a center of buoyancy, a bow, and a stern. Each float is defined by having a sculpted hull comprising (a) a substantially straight and generally flat inward side running from said bow to said stern, (b) a substantially convex outward side having convexity, a top edge and a bottom edge, said substantially convex outward side and said convexity running from said bow to said stern, and said convexity being away from the direction of said substantially straight inward side, said substantially convex side additionally being farther from said inward side at said top edge than at said bottom edge, and (c) a bottom side in watertight connection with said substantially straight inward side and said substantially convex outward side, said substantially straight side, said substantially convex outward side, and said bottom side forming a smooth and continuous exterior surface. Said hull is covered by a top surface. In addition, said sculpted hull comprises a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy. In some embodiments, said apparatus further comprises a tether having a length and connecting said first buoyant float to said second buoyant float. The substantially convex outward side and the substantially straight inward side of the hull act cooperatively to form an aerofoil whereby said sculpted hull experiences an outwardly force in use. In another embodiment, the center of buoyancy of the float is at least as high as the predicted height of said user's ankle in said foot well. In yet another embodiment, the bottom surface of said foot well further extends to the bottom side of the hull. The foot well may also comprise a foot well cover hingedly attached to the top surface of said first or said second buoyant float, said foot well cover being adapted to hold said user's foot in said foot well when said foot well cover is closed. In an even more preferred embodiment, the apparatus comprises a foot interface comprising a first surface connected to said foot well cover, and a second surface adapted to surround the upper surface of said user's foot and the anterior surface of said user's ankle in said foot well. In yet other embodiments, the bottom side further has a generally convex shape having convexity, said convexity being away from the direction of said top surface, said bottom side further comprising a flat platform extending under the bottom surface of said foot well, said platform being generally parallel to the plane of said water.

In another embodiment, the apparatus comprises a track disposed parallel to the water on said substantially straight inward side, and an attachment rider adapted for traversing said track and for accepting said tether, wherein said rider traverses said track when pulled by said tether. In yet another embodiment, the tether restricts movement between said first float and said second float in only one degree of freedom, said degree of freedom being substantially in the direction perpendicular to both the direction of travel and the vertical direction, wherein said restriction is furthermore only a limit on the maximum separation allowed in said direction. Other embodiments for tethering the two floats include a first cable comprising two ends, said two ends attached to said substantially straight inward side of said first buoyant float at two locations at the approximate predicted height of the user's ankle in said foot well, and a second cable intertwined at least once through said first cable, said second cable further comprising two ends attached to said substantially straight inward side of said second float at two locations at the approximate predicted height of the user's ankle in said foot well. In some embodiments, a friction reducing agent is coated on one or more of said cables. Also, the tether may be connected to a buoyant float by an adjustable attachment device, said device connecting said tether to said first float, wherein said adjustable attachment device can be used by a user to adjust the separation between said first float and said second float.

Additionally, other devices can be attached to one or both of said buoyant floats. In one embodiment, an articulation interface is attached to the stern of one float. The articulation interface is adapted for attaching a flap with a forward edge that is perpendicular to said direction of travel. In another embodiment, the buoyant float comprises an outside surface, and one or more accessory attachment interface adaptations for attaching one or more accessories are attached to said outside surface. In one embodiment, the accessory comprises one or more generally pointed protuberances adapted for increasing traction on ice in contact with said protuberances. In yet another embodiment, said accessory comprising a propulsion mechanism retraction interface located at the stern of said first buoyant float and adapted to facilitate the retractable attachment of a propulsion mechanism, which is operational when it is at least partially immersed in the water and not operational when it is substantially retracted from the water, to said float, said retraction interface comprising (a) a pivot bracket attached to said first buoyant float and adapted to pivotally connect to said propulsion mechanism, (b) a fixed anchor point attached to said first buoyant float, and (c) a retention spring adapted for connection between said propulsion mechanism and said fixed anchor point; thus, when a propulsion mechanism is attached to said pivot bracket and said retention spring, said retention spring is stressed, and said stressed retention spring generates a force on said propulsion mechanism directed to keep said propulsion mechanism at least partially immersed in water, wherein said propulsion mechanism can pivot between being at least partially immersed in water and substantially retracted from water in response to torque.

In yet another embodiment, a buoyant float may be comprised of two or more modular members shaped to fit together to form said first buoyant float.

In yet another embodiment, the invention provides a kit for producing a float for floatation and transportation on water, comprising at least two modular members sized to fit together to form a buoyant float having a center of buoyancy, a bow and a stern, said buoyant float further comprising a hull. Each hull comprises (a) a substantially straight and generally flat inward side running from said bow to said stern, (b) a substantially convex outward side having convexity, a top edge, and a bottom edge, said side and said convexity running from said bow to said stern and said convexity being away from the direction of said substantially straight inward side, said substantially convex side further being generally tilted from a top edge to a bottom edge, said top edge being generally farther from said substantially straight inward side than said bottom edge, and (c) a bottom side in watertight connection with said inward side and said outward side, said three sides forming a smooth and continuous exterior surface. Each float further comprises a top surface covering said hull and a foot well for housing said user's foot and ankle, said foot well disposed through said top surface of said float and extending toward said bottom side, said foot well further located to position said user's ankle substantially in vertical alignment with the center of buoyancy, and said foot well further comprising a bottom surface that is below said center of buoyancy of said float. Preferably, at least one of said one modular member comprises an attachment point for a tether at the approximate predicted height of the user's ankle in said foot well.

In other embodiments, the invention provides a propulsion mechanism for propelling a water craft through water in a direction. Such a propulsion mechanism comprises (a) a support structure comprising a support element, said element comprising a first dimension, a second dimension, a third dimension, a first end of said first dimension and a second end of said first dimension, said first end comprising an adaptation for attachment to said water craft, and (b) a buoyant flap comprising a leading edge, a trailing edge, a width between said leading edge and trailing edge and an articulation point located within the first 25% of said width as measured from said leading edge, said buoyant flap articulated to said second end of said support element at said articulation point, said articulation having an axis of rotation that is both within 45 degrees of horizontal and substantially perpendicular to said direction of travel, said buoyant flap being movable substantially in rotation about said axis, said rotation being in a semicylindrical space behind said axis, said space being away from said direction of travel.

In another embodiment, the propulsion mechanism comprises (a) a support structure comprising a support element, said element comprising a first dimension, a second dimension, a third dimension, a first end and a second end, said first end comprising an adaptation for attachment to said water craft; (b) a flap comprising a leading edge, a trailing edge, a width between said leading edge and trailing edge and an articulation point located within the first 25% of said width as measured from said leading edge, said flap articulated to said second end of said support structure at said articulation point, said articulation having an axis of rotation that is both substantially within 45 degrees of horizontal and substantially perpendicular to said direction, said flap being movable substantially in rotation about said axis, said rotation being in a quarter-cylindrical space behind said axis, said space being away from said direction of travel and generally above the horizontal, and (c) a rotation limiting mechanism situated on one of said support structure, said flap or said water craft for preventing the flap from rotating beyond a position substantially parallel to said direction.

In yet another embodiment, the propulsion mechanism comprises (a) a support structure comprising a support element, said element comprising a first dimension, a second dimension, a third dimension, a first end and a second end, said first end comprising an adaptation for attachment to said water craft, (b) a flap comprising a leading edge, a trailing edge, a width between said leading edge and trailing edge and an articulation point located within the first 25% of said width as measured from said leading edge, said flap articulated to said second end of said support structure at said articulation point, said articulation having an axis of rotation that is substantially perpendicular to said direction, said flap being movable substantially in rotation about said axis, said rotation being in a semicylindrical space behind said axis, said space being away from said direction of travel, (c) a rotation limiting mechanism situated on one of said support structure, said flap or said water craft for preventing the flap from rotating beyond a position substantially perpendicular to said direction, and (d) a torque generating mechanism connected between said flap and said support structure, said mechanism comprising a stressed material exerting torque on said flap, said torque directed so as to rotate said flap toward a position substantially perpendicular to said direction, said torque being exerted on said flap at all rotation positions of said flap.

In yet another embodiment, the propulsion mechanism comprises (a) a pivot axis, (b) a pivot support bracket adapted for attachment to said water craft and adapted for supporting said pivot axis, (c) a foot actuated pedal crank comprising a first end connected to said pivot axis, a second end, and a pedal attached to said second end, (d) a support structure comprising a generally elongated bar element, a first end and a second end, said first end attached to said second end of said pedal crank, said attachment forming a predetermined angle between said bar element and said pedal crank, said angle measured in a plane perpendicular to said pivot axis, and (e) a flap comprising a leading edge, a trailing edge, a width between said leading edge and trailing edge and an articulation point located within the first 25% of said width as measured from said leading edge, said flap articulated to said second end of said support structure at said articulation point, said articulation having an axis of rotation that is substantially perpendicular to said direction, said flap being movable substantially in rotation about said axis said rotation being in a semicylindrical space behind said axis, said space being away from said direction of travel. Preferably, said apparatus further comprises a rotation limiting mechanism situated on one of said support structure or said flap for preventing the flap from rotating beyond a position substantially perpendicular to said direction. In another preferred embodiment, said apparatus comprises a torque generating mechanism connected between said flap and said support structure, said mechanism comprising a stressed material exerting torque on said flap, said torque directed so as to rotate said flap toward a position substantially perpendicular to said direction, said torque being exerted on said flap at all rotation positions of said flap. Said flap is preferably buoyant and said axis of rotation is preferably within 45 degrees of horizontal.

BRIEF DESCRIPTION OF THE SEVERAL VIEWS OF THE DRAWING

The foregoing and other objects, features and advantages of the invention will become apparent from the following description in conjunction with the accompanying drawings, in which reference characters refer to the same parts throughout the different views. The drawings are not necessarily to scale; emphasis has instead been placed upon illustrating the principles of the invention. Of the drawings.

DETAILED DESCRIPTION OF THE INVENTION

Figure 1:
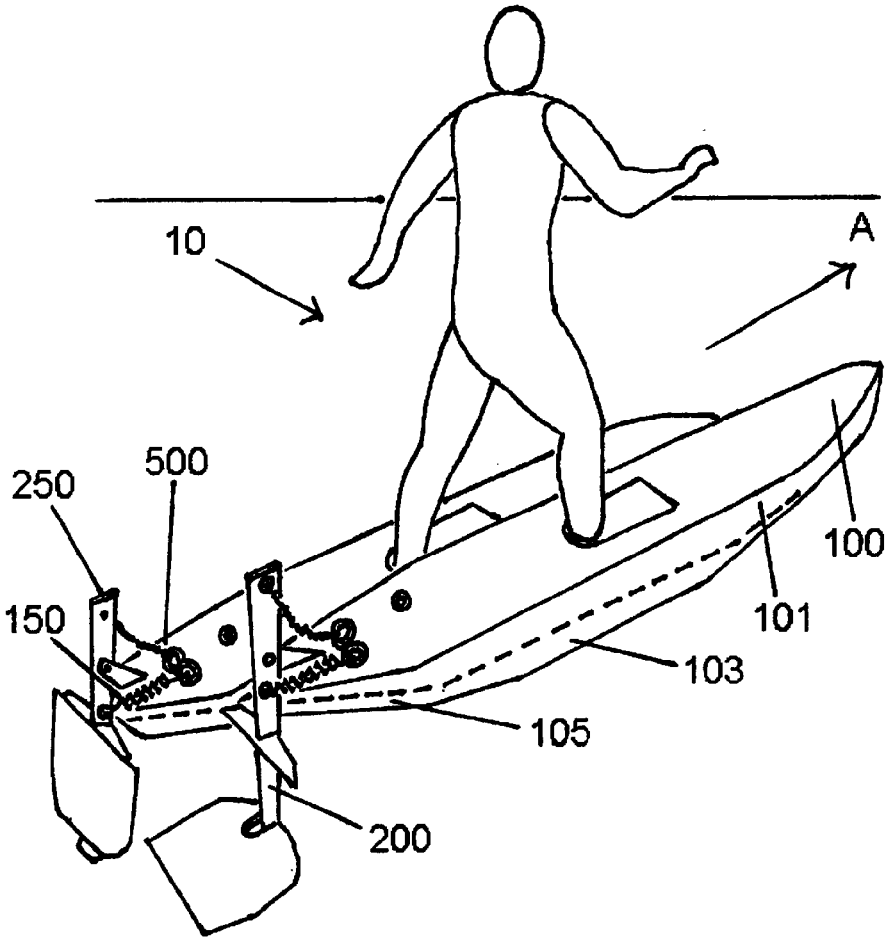
FIG. 1 illustrates the invention as it is used for water-walking.

Many aquatic activities can be enjoyed by a person in an upright, standing position, for example, fishing, water skiing, surfboarding, and windsurfing. Other upright activities, such as Nordic and alpine skiing, could also be enjoyed on water if proper equipment were available. As shown in FIG. 1, the invention comprises an apparatus 10 that can be embodied for water-walking by an upright human by attaching a propulsion mechanism 200 to each of a pair of floats 100 which have been tethered together by a tethering mechanism (not illustrated). By taking natural walking strides the user can propel himself in the forward direction, indicated by arrow "A". Other embodiments of the invention may be optimized for other aquatic activities. In one aspect the invention is an apparatus resembling pontoon boats, one for each foot, on which a human can stand upright with great stability. Preferably, the apparatus allows each foot and leg to experience all the degrees of freedom normally associated with walking or standing on land while minimizing the unfamiliar foot/leg motions that arise from the fluid nature of water. In one aspect the apparatus comprises two main functional elements; the float, providing stable buoyancy and control, and the foot attachment well, for transmitting foot/leg motions to the float. The presence of the tether is preferable, but not absolutely required, for maintaining two side by side floats in a comfortable relationship. The apparatus also includes accessory attachment interface adaptations to which various accessories and propulsion systems may be affixed. In one embodiment, the primary propulsion force is human power and the primary mode of propulsion is walking and/or skating. In other embodiments, the propulsion mode may include but not be limited to: sailing, wind-surfing, wave-surfing, and river-skiing. Accessory devices such as sails, stabilizers, ice-steppers, etc. are accommodated by the invention. For convenience in the figures, we define a three dimensional coordinate system wherein said forward direction shall be considered the x-direction, the perpendicular to the plane of the water shall be considered the z-direction, and the remaining orthogonal axis shall be considered the y-direction.

Typically, two floats are used in most aquatic activities. In one embodiment, each float comprises a hull, a top surface, and a foot attachment mechanism, and, optionally, may include accessory attachment interface adaptations, fixtures and accommodations for various accessory devices. Preferably, the accessory attachment interface adaptations are located on the outside surface of hull 101. For example, ice walking accessories may be added to the bottom and/or bow of each float. The ice walking accessories typically comprise one or more pointed protuberances or, preferably, aftward facing sawteeth. On solid ice the protuberances supplement the tips of the propulsion mechanism to provide the grip to the ice needed to walk forward. On thin ice the invention breaks through to water and operates normally. In the transition from water to ice, the protuberances at the bow provide extra grip to pull the float up out of the water. In another embodiment, the float comprises an articulation interface located at said stern and adapted for attaching a flap with a forward edge that is perpendicular to said direction of travel.

In other embodiments, the invention provides for one or more articulation interfaces attached at the bottom or one of the side surfaces of the float.

Figure 2:
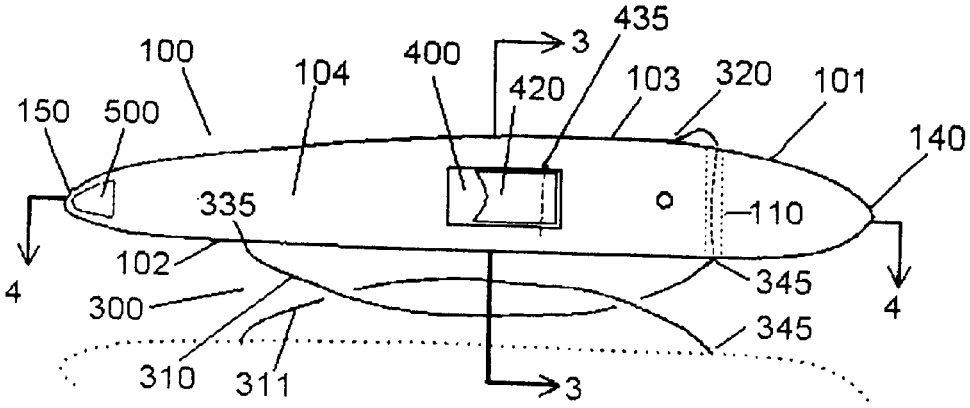
FIG. 2 is a schematic top view of a unitary embodiment of the apparatus showing the tethering assembly.

The top view of one of said two floats is shown in FIG. 2. The left float is illustrated in the figure and it will be understood that the right float and left floats are mirror images of each other. As shown in FIG. 2 and in sectional views in FIG. 3 and FIG. 4, float 100 is primarily a generally elongated, buoyant sculpted hull 101 and a flat top surface 104 covering said hull. Hull 101 is formed from a marine material. Examples of such materials include plastic and resin impregnated fiberglass. Other marine materials are well known to those skilled in the art. The float has, preferably, a smoothly varying, continuous surface shell 165 and may be hollow or, preferably, filled with a low-density material 170 such as polyurethane foam.

Typically, each float is sized to support the total weight of the intended user, with an added margin of approximately 5–40%, preferably 5–20%, most preferably 10%. Thus, the volume V of displaced water for each float may be calculated using the density of (fresh) water according the formula:

$$V = {}^{(1.1U+m)}/_{D_w} \tag{1}$$

where U is the mass of the user, m is the mass of the float and $D_w$ is the density of water. While this volume could be distributed in any shape to provide the required buoyancy, the inventor has determined that a float whose length approximates the height, H, of the user and has a width on the order of 20–30 cm, and preferably 25 cm provides a reasonable compromise between stability and maneuverability for many applications. It should be noted, however, that specific applications will require specific hull parameters; a long, thin hull for speed, for example, or a short, deep hull for extra stability when wading for fishing. The volume of said compromise float, which is calculated according to equation (1), is achieved by setting the depth of the float to V/0.25H. For example, a float for a 1.8 meter tall user with a mass of 90 kg might have the general dimensions of 1.8 meters×0.25 meters×0.28 meters (L×W×D), where the indicated depth (0.28 meters) is actually greater than required for buoyancy, the extra depth being the height of the float above the waterline. Said extra depth maintains the top surface 104 well clear of the water and helps keep the user dry. Additionally, the extra depth provides reserve buoyancy.

As a matter of definition, the centroid of the displaced water (i.e., the centroid of the hull below the waterline) is the Center of Buoyancy (CoB) and is the point through which the buoyant force appears to operate (in analogy to the center of gravity).

Float and Hull Shape

The inventor has observed that when two parallel floats move through the water, a region of lower pressure is created in the channel formed by the parallel floats, said lower pressure tending to draw the two floats together and cause instability and bumping interference. Therefore, as shown in FIG. 2, hull 101 is generally asymmetric in cross-sections parallel to the plane of the water. This general shape is preferred to typical prior symmetric shapes. The preferred shape is generally an aerofoil, or wing-shaped; a thusly shaped hull 101 counteracts aforesaid low pressure and prevents said instability and bumping.

Addressing the hull shape more specifically, as is well known in the design of other aquatic floatation apparatuses such as kayaks and sailboats, no one preferred hull design exists. Instead, hull design parameters are determined in a give and take trade off to match the expected requirements of different applications and water conditions, various user preferences, various user body mass, muscle power, and morphologies, and so on. With this understanding, the following description of the preferred hull design should be understood as illustrative of the design principles involved rather than definitive hull design, and is not intended to limit the scope of the invention.

Hull 101 has a substantially straight and generally flat inwardly facing side 102 and a substantially convex outwardly facing side 103, where the substantially straight and generally flat side 102 is the side facing the second float 100 on the user's feet used in apparatus 10. Side 102 is substantially straight, running from a bow 140 to a stern 150, while substantially convex side 103 is generally convex, also running from bow 140 to stern 150. Substantially convex outward side 103 has convexity, a top edge, and a bottom edge, said substantially convex outward side and said convexity running from the bow 140 to the stern 150 and said convexity being away from the direction of said substantially straight and generally flat inward side, said substantially convex side additionally being farther from said substantially straight and generally inward side at said top edge than at said bottom edge. As used herein, the term "convexity" refers to the quality of something that is convex, and is not meant to imply an extra limitation or structure other than the convexity already present in the convex side or other convex member. Hull 101 is said to be "generally wing shaped" insofar as the bow-to-stern distance along substantially convex side 103 is longer than the bow-to-stern length of substantially straight and generally flat side 102 and is convex, thereby producing an outward force in the same manner as a wing generates lift. The sides 102, 103 are tapered as they approach both bow 140 and stern 150 to form a smooth and continuous curve without rapidly changing bends that would disrupt hydrodynamic streamlining. Additionally, hull 101 has a bottom side 105 in watertight connection with said substantially straight and generally flat side 102 and said substantially convex side 103, said bottom side 105 being smoothly blended into sides 102 and 103 so as to form a preferred unified sculpted hull.

Figure 3:
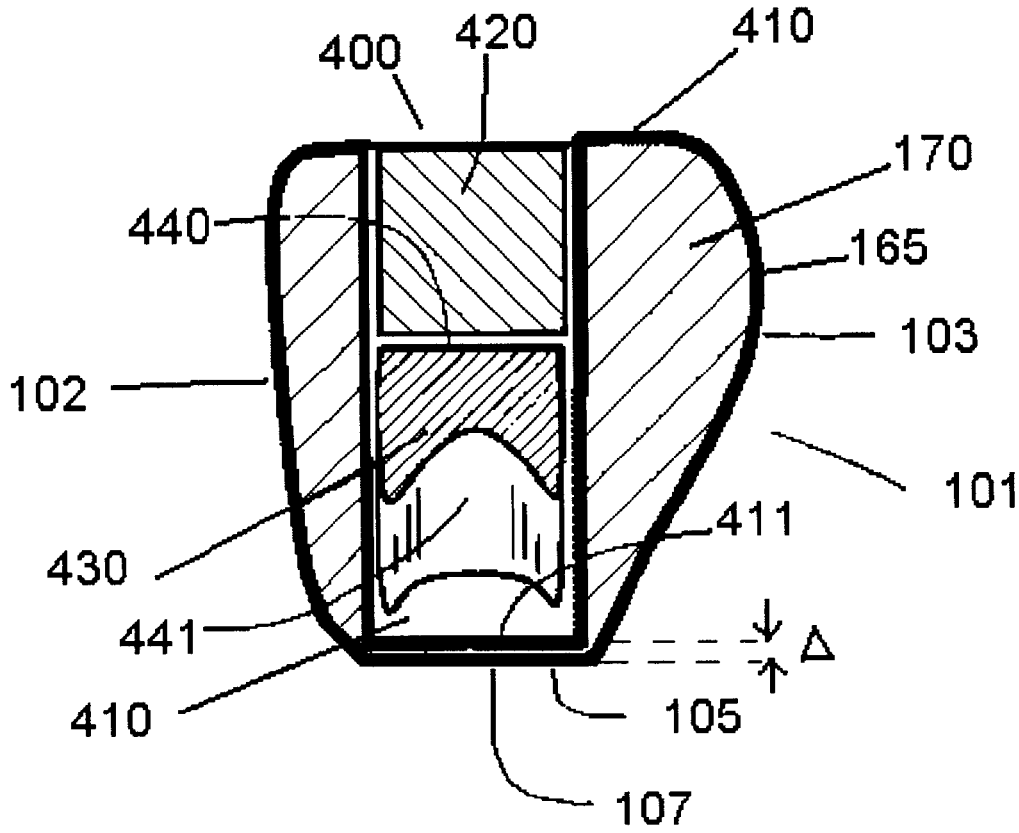
FIG. 3 is a sectional view of one embodiment of the float, illustrating a typical transverse hull shape.
Figure 5:
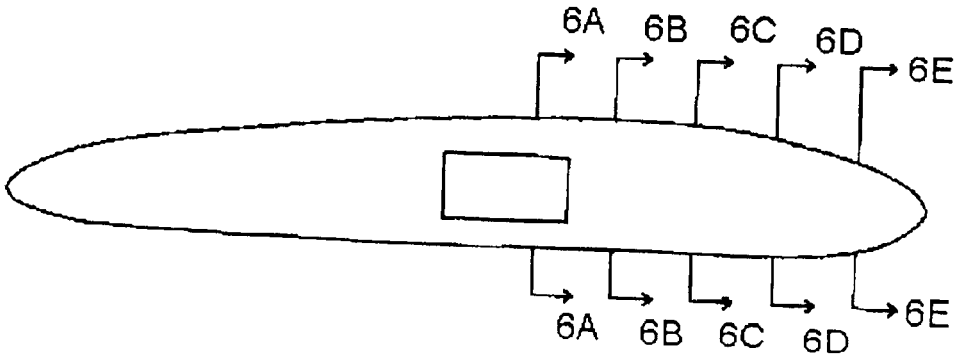
FIG. 5 is a schematic top view of the float illustrating the location of several sectioning planes.

FIG. 3 shows a sectional view of the float in FIG. 2 taken at the sectioning plane indicated by line 3—3. As illustrated at this section, and at all other transverse sections, the substantially straight and generally flat side 102 is generally vertical while the substantially convex outward side 103 is tapered generally inwardly from top surface 104 toward a keel line 107 at the lowest point on the bottom side 105. As will be described in more detail later, the generally rectangular platform or portion of bottom side 105 that lies directly beneath foot attachment mechanism 400 is substantially flat.

Figure 4:
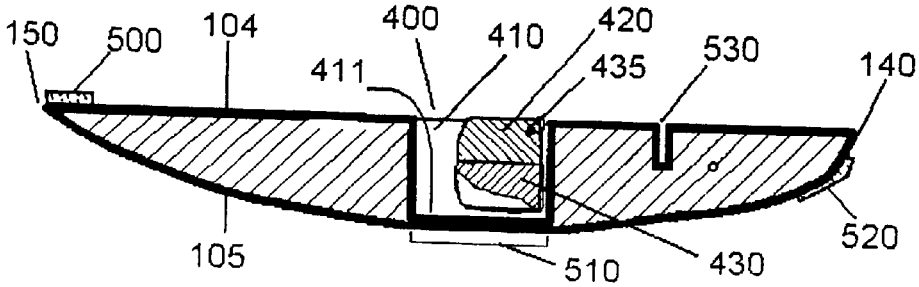
FIG. 4 is a sectional view of one embodiment of the float illustrating details of one embodiment of the foot attachment mechanism and other float features.

FIG. 4 shows a sectional view of the float in FIG. 2 taken at the sectioning plane indicated by line 4—4. As illustrated at this section, and at generally all other longitudinal sections, bottom side 105 is preferably generally convex. The convexity faces away from the direction of said top surface 104.

Figure 6:
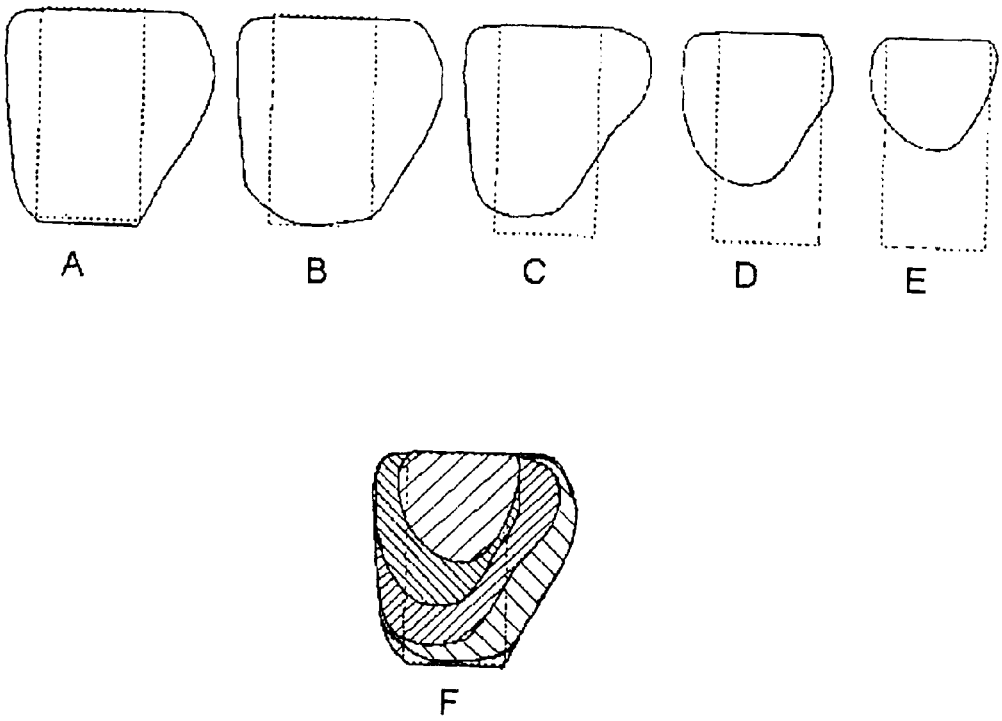
FIGS. 6A through F are several sectional views of the float.

In this preferred embodiment, the lowest point along keel line 107 lies directly beneath foot attachment mechanism 400 and, as described above, this generally rectangular portion of bottom side 105 is substantially flat. In a more preferred embodiment, the portion of bottom side 105 that is directly under the foot attachment mechanism 400 is flat while the remainder of the bottom side 105 slants upwards from the flat portion to the bow 140 or stern 150. FIG. 5 and FIGS. 6A–F illustrate the overall changing shape of float 100. FIGS. 6A–E are sectional views of the float in FIG. 5, taken at the indicated sectioning planes, while FIG. 6F is an overlay of all of said sectional views. The rectangular boxes in the figures indicates the position of the foot attachment mechanism and is included in the figures only to provide a frame of reference for the different sectional views.

FIG. 4 also illustrates some of the many optional attachment fixtures that may be included on specific embodiments of float 100. For example, a propulsion mechanism attachment fixture 500 is illustrated at the preferred stern location on float 100, said attachment fixture 500 being adapted to accept available propulsion mechanisms. Similarly, a keel/ballast attachment fixture 510 is shown in its preferred location immediately below foot attachment mechanism 400, said fixture being adapted for adding ballast to lower the system center of gravity or for a stabilizing keel as might be desired for "float surfing" or "river skiing" versions of float 100. Another example of an optional attachment fixture is a mast retention socket 530 into which a mast for float windsurfing or sailing can be placed. A last illustrated example is an ice-gripper attachment fixture 520 near the up-sloping region near the bow of float 100, said ice-gripper being a set of aftwardly facing metal proturbences that provide traction during the ice-to-water transition. Said proturbences would be of particular value on a float that has been adapted for ice rescue missions. It is understood that the various attachment fixtures will be adapted to match the accessory for which they are intended. Preferably, said fixtures will accept accessories without the need for tools and will not interfere with the streamline shape of the hull. For example, a recessed T-groove may be molded into bottom side 105, said T-groove accepting one or more T-shaped projections from a keel or ballast accessory.

Figure 16:
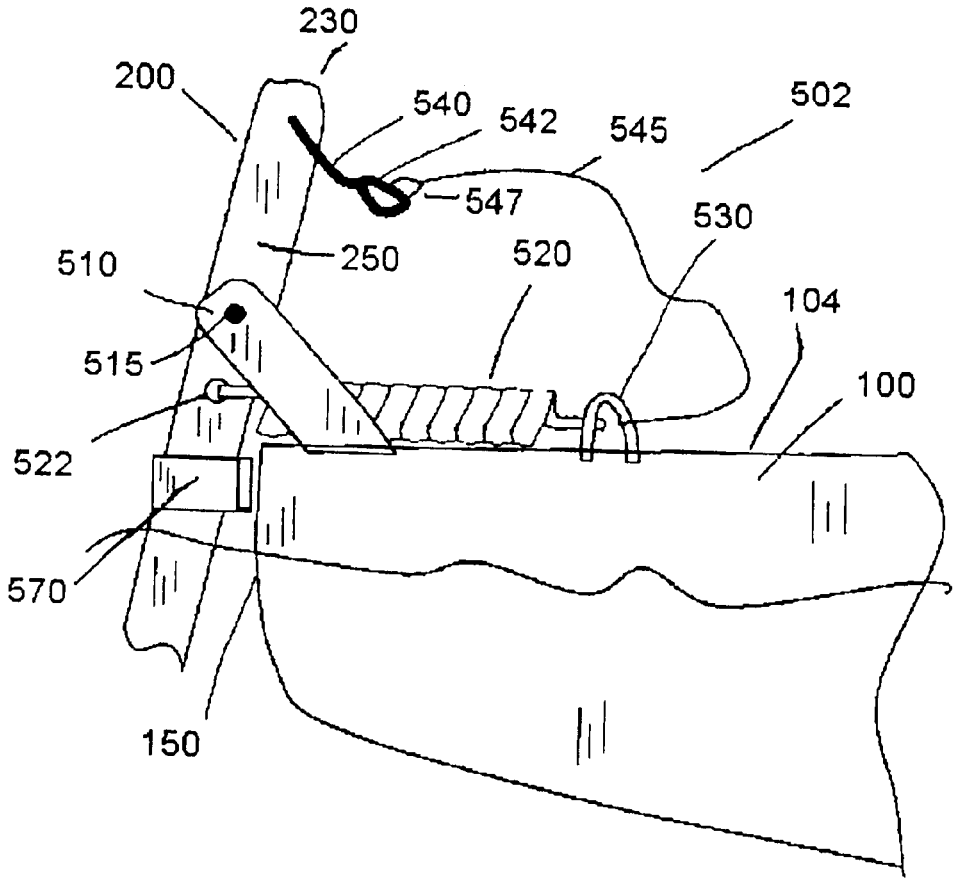
FIG. 16 is a view of an adapter mechanism for attaching one embodiment of the propulsion mechanism to the stern of a float.

In another embodiment, the accessory comprises a propulsion mechanism retraction interface located at stern 150 of float 100 and adapted to facilitate the retractable attachment of a propulsion mechanism to said float that is operational when it is at least partially immersed in the water and not operational when it is substantially retracted from the water. FIG. 16 illustrates this accessory with the propulsion mechanism 200 attached. The retraction interface comprises a pivot bracket 510 attached to float 100 and adapted to pivotally connect to the propulsion mechanism, a fixed anchor point 530 attached to float 100, a retention spring 520 adapted for connection between the propulsion mechanism and the fixed anchor point 530. When the propulsion mechanism is attached to the pivot bracket 510 and the retention spring 520, retention spring 520 is stressed and generates a force on the propulsion mechanism directed to keep the propulsion mechanism at least partially immersed in water. The propulsion mechanism can pivot between being at least partially immersed in water (i.e., an operational position) and substantially retracted from water (i.e., a non-operational position) in response to torque. This accessory is substantially similar to the propulsion mechanism retraction interface described in the context of the propulsion mechanism, below, except that it may be attached without the propulsion mechanism to float 100, and may remain without a propulsion mechanism until a propulsion mechanism is desired.

Figure 9:
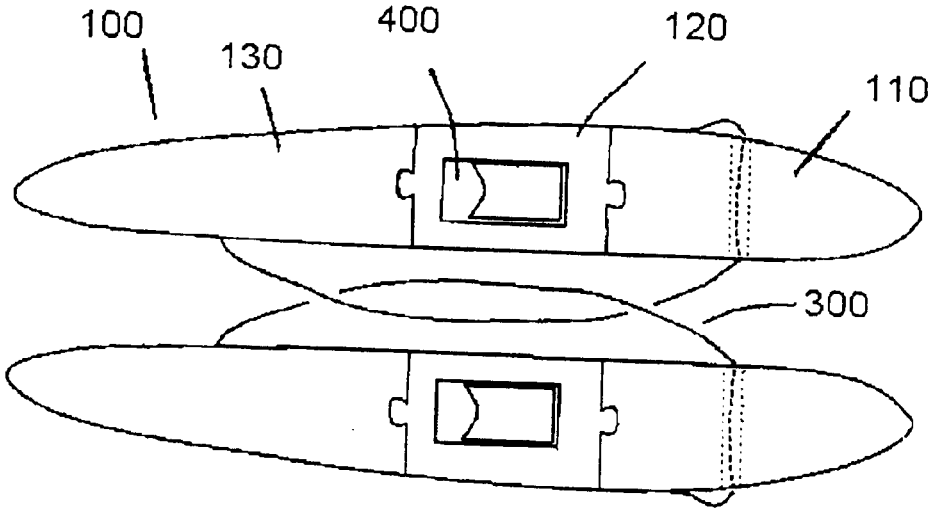
FIG. 9 is a schematic top view of a modular embodiment of the invention.

A modular preferred embodiment of float 100 is illustrated schematically in FIG. 9. In that embodiment, each float comprises three modules, said modules being used to adjust the length of the float to accommodate users of different weights. In this embodiment the central module 120 houses the foot attachment mechanism 400. The fore and aft ends of module 120 are adapted to accept an interchangeable bow module 110 and an interchangeable stern module 130, said adaptation being shown schematically as an interlocking vertical channel. Many alternative removable interface designs may be used to equal advantage.

Preferably both the substantially straight and generally flat inwardly-facing side 102 and the substantially convex outward facing side 103 of module 120 are straight in all sectioning planes parallel to the surface of the water, said shape facilitating smooth and continuous matching with various bow and stern modules.

Bow module 110 and stern module 130 are designed with interface surfaces that correspond to the respective fore and aft ends of module 120. The other surfaces of modules 110 and 130 conform to the design used for the respective portions of float 100, including accommodations for tethering mechanism 300 and any accessory attachment fixtures that may be desired.

Foot Attachment Mechanism

Returning to FIGS. 3 and 4, the illustrated sectioning planes have been selected to cut through foot attachment mechanism 400. Attachment mechanism 400 comprises a foot well 410. Preferably, it further includes a foot well cover 420 pivotally attached to top surface 104 by a foot well cover hinge 435. More preferably, it further comprises a foot interface 430, having a first surface 440 connected to said foot well cover, and a second surface 441 adapted to surround the upper surface of said user's foot and the anterior surface of said user's ankle in said foot well. The foot well 410 is located substantially at the center of buoyancy in the horizontal plane, said positions the user's ankle substantially in vertical alignment with the center of buoyancy. As illustrated, foot well 410 has a bottom surface 441 that preferably extends as deeply as possible into the float, limited only by the thickness, Δ, of bottom side 105 at the keel line 107. Thickness Δ is determined by the strength of the material used in that region of the hull. In the illustrated example, the bottom of the well is formed by two layers of the hull material with no low density material 170 between them, although it should be understood that a single layer of a suitably strong material is functionally equivalent. Foot well 410 allows the user's foot to reside low inside float 100 to position the user's foot below the center of buoyancy, providing stability. Specifically, with the foot normally located at the lowest point of the float, any pitching or rolling motion of the float will raise the foot (and thus raise the user's center of mass). Since the stable point of the system is the point of lowest potential energy, the float will resist this pitching or rolling, returning the foot to the original low point.

Foot well 410 is generally sized and generally shaped to match a user's foot. Additionally, the location of foot well 410 in relationship to the rest of the float is defined where the user's foot should be located. A user's mass is supported by his or her legs, with the feet serving as interfaces with the ground. We define the mass support point, MSP, to be the point at which an extension of the tibia intersects the horizontal plane on which the foot is resting (the MSP is generally just forward of the heel). Since the MSP is preferably located directly below the CoB to eliminate any tilt or roll inducing torque, the user's foot is preferably to be located to effect this alignment. Since the foot well 410 is shaped to accommodate the user's foot, its position locates the foot to its preferred location.

The inventor has realized as a result of design trade offs among several requirements that foot well 410 is preferably positioned closer to side 102 than to side 103. It is preferable that the MSP be no farther from substantially straight and generally flat 102 than one-half of the user's natural stance. Further, foot well 410 is wide enough to comfortably accept a user's foot. Further, the center line of foot well 410 (viz., the line containing the MSP) is preferably coincident with the transverse position of the CoB (requires equal displaced volume to the inside and outside). The float 100 is preferably wing-shaped, forcing substantially convex side 103 to have a convex, or outward bow and another constraint is that the required buoyancy (viz., volume of displaced water) should be achieved with a reasonable length float, leading to a specific minimum float width (additionally, stability requirements do not allow a narrow, foot-width float). The inventor has constructed one embodiment of the float having each of these preferred features, in which the center line of the foot well is approximately 11.4 cm from substantially straight and generally flat 102 and 14 cm from substantially convex side 103, as measured on top surface 104.

Returning to FIG. 4, foot well 410 defines the location into which a user places his foot. The foot well cover 420, in cooperation with foot interface 430, forms a lid that holds the foot snugly but comfortably in place at the bottom of foot well 410. Foot interface 430 is preferably an exchangeable, generally concave-shaped component that is adapted to different foot sizes and foot coverings. It is designed to fit over the top of the front of the foot, encasing the foot from the toes to generally the arch and from the mesial side to the distal side. The interface 430 is generally fabricated from a compliant material, for example a high density foam. The interface can be designed for a bare foot, as might be required for river water skiing or for a footwear shod foot, as might be required for ice-rescue wherein a warm, waterproof boot is likely to be worn.

Foot interface 430 may be removably attached to the bottom surface 105 of foot well cover 420. Foot well cover 420 in cooperation with interface 430, holds the user's foot in foot well 410 during use. Foot well cover 420 is removed from its functional position to allow insertion or extraction of the foot from well 410. Preferably, foot well cover 420 is removed by rotating said foot well cover upwards about the foot well cover hinge 435. Many alternative hinge designs and approaches may be used to perform this function. Typically, foot well cover 420 is fabricated with the same technology as is used for float 100.

Foot well cover 420 should be held in the closed position with enough force to keep the foot in place during normal use. However, for safety reasons, foot well cover 420 should preferably also be able to release the foot quickly, for example, if the user falls sideways into the water. Any of a number of quick release mechanisms such as weak springs or detent-type mechanisms may be utilized. The inventor has determined that a close fit between foot well cover 420 and the sides of foot well 410 provides adequate frictional force to hold the foot in place whilst allowing the cover to open with large impulse of a quick kicking motion.

Tethering Mechanism

Float 100 also comprises the tethering mechanism 300. Tethering mechanism 300 preferably constrains the two floats 100 from spreading apart in the y-direction by more than a pre-determined distance. Preferably tethering mechanism 300 operates only in the aforesaid y-direction and does not constrain the floats in any other of the remaining 5 mechanical degrees of freedom. Furthermore, mechanism 300 preferably operates only to limit the separation between the floats 100 to the predetermined distance, said distance being preferably equal to the user's normal standing foot separation, while allowing floats 100 to come together without constraint. FIG. 2 illustrates one preferred embodiment of tethering mechanism 300. The mechanism 300 comprises a first cable 310 attached at two points to left float 100 and a second cable 311 attached correspondingly at two points to the right float (not illustrated). Cables 310 and 311 are typically flexible, woven metal braids, preferably coated with a permanent, snag and friction reducing coating 340, typically a material such as nylon or PVC, or any other material that provides a smooth and durable finish. Preferably, the coating is smooth and hard enough to enable easy sliding when moving along a similar cable. Even more preferably, the coating is resistant to abrasion, corrosion, and UV radiation, and will retain its smooth finish with use. Alternately, the friction reducing coating can be a lubricant that reduces friction. Other types of cables and coatings appropriate for use in the present invention are known to the skilled artisan.

The two cables are intertwined by threading one cable through the loop formed by the second cable, said intertwining preferably comprising preferably one or more overlaps. In the preferred embodiment illustrated in FIG. 2, the first end of cable 310 is attached to the first float 100 at an attachment point 335, generally rearward of the mid-point along substantially straight and generally flat side 102. In other embodiments, attachment point 345 may be included, which is generally forward of the mid-point along side 102. Preferably attachment points 335 and 345 are recessed below the surface of the float to avoid snagging on the second float 100, and most preferably are at the approximate height of the user's ankles in the foot wells. In one preferred embodiment, the second end of cable 310 is attached to first float 100 by passing through a tether tunnel 110, which is a cylindrical passage hole running from side 102 to side 103, said tunnel located generally forward of the mid-point along side 102. Cable 311 is similarly attached on the second float 100. When referring to the tethering mechanism in terms of cable 310, it will be understood that the description may equally refer to cable 311.

Emerging from tunnel 110, cable 310 is attached to float 100 at an adjustable attachment device, such as an adjustable attachment clamp 320. Preferably clamp 320 operates without tools to hold or release cable 310, allowing the effective length of cable 310 to be adjusted to match the preferred stance of each user. Clamp 320 may be located on the outwardly facing substantially convex side 103, as illustrated, so that it does not interfere with the adjacent float. Although not illustrated, stowage capability (a compartment or tie down) for the excess cable (the cable beyond clamp 320) may be optionally included on float 100. Although clamp 320 is illustrated on side 103, with the cable passing through tunnel 110, as an example, it should be understood that alternative clamp locations and cable routing schemes may equally well be used.

Figure 7:
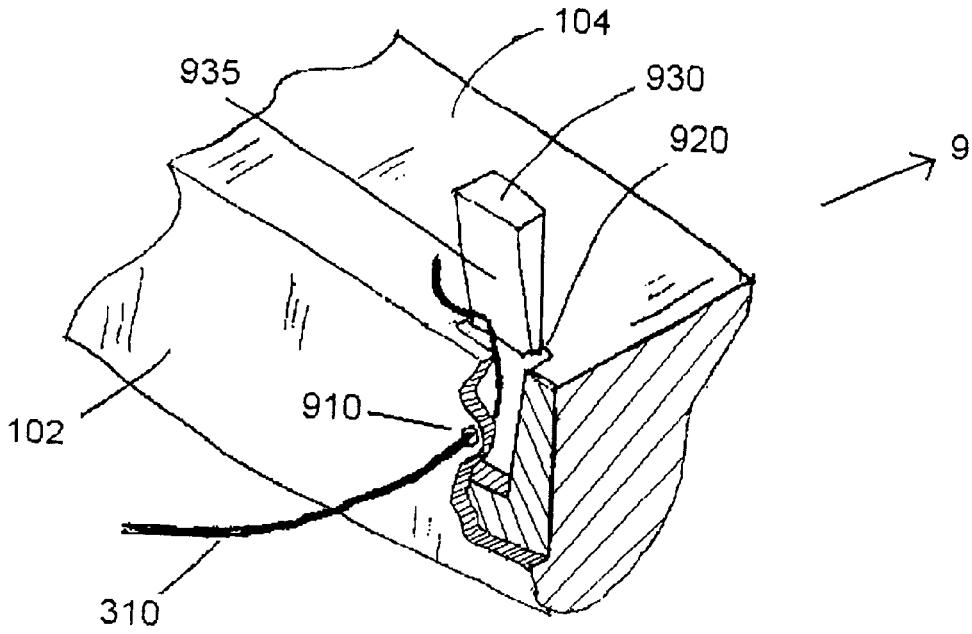
FIG. 7 is a partial sectional view of the float showing one embodiment of a cable clamp.

In another preferred embodiment, tunnel 110 is replaced with an interior clamp mechanism, as shown in FIG. 7. Cable 310 penetrates inwardly facing hull substantially straight and generally flat side 102 at a cable entrance 910 and is immediately directed upwards along a vertical interior channel 920 to top surface 104, said channel being substantially rectangular in cross-section, typically with its wider sides generally parallel to side 102. The cable shares channel 920 with a slightly tapered clamping chock 930 said chock being generally matched to the shape of the channel. Chock 930, being generally a rectangular solid, comprises two end faces (a top and a bottom), two thin edge faces (a left and a right), and two wide faces (a front and a back), wherein the front face 935 is parallel to side 102 and also faces inwardly. Chock 930 is tapered from top to bottom, where in the top is, for example, 5% wider in the y-direction than is channel 920 and the bottom is 5% narrower than said channel. Said taper is only applied to front face 935. A groove (not illustrated) runs along said front face from bottom to top and in line with cable entrance 910. The groove is slightly less deep than the diameter of cable 310, providing a guide for said cable. When the chock and said guided cable are gently inserted into channel 920, the cable can be pulled up or down in the groove to adjust its length; however, when the chock is pressed further into channel 920, said chock becomes wedged tightly, pinioning cable 310 in place.

Returning to the embodiment of FIG. 2, fixed attachment point 335 and the entrance of tunnel 110 are substantially at the same height on side 102. Preferably, this height is substantially parallel to the user's ankle when the user's foot is secured in foot well 410, said height selected to reduce roll-inducing torque when tension is applied to cable 310.

Fixed attachment points 335 and 345 may advantageously be designed to permit tool free detachment of cable 310, said detachment being more convenient for separating said floats during transport and/or storage than using adjustable clamp 320 and threading cable 310 through tunnel 110.

Figure 8:
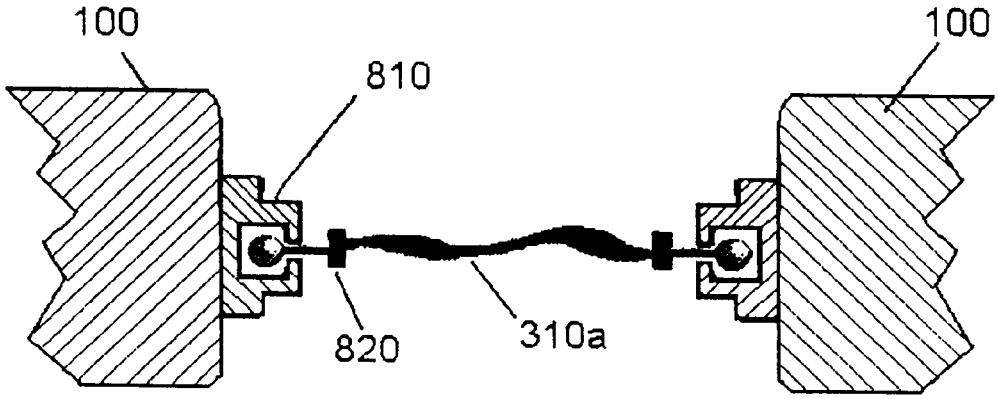
FIG. 8 illustrates a second embodiment of the tether mechanism.

Another embodiment of a tether mechanism is illustrated in cross section in FIG. 8. The mechanism on at least one float comprises at least one elongated track 810 installed on the substantially straight and generally flat inward side 102 parallel to the water and at the approximate height of the user's ankle, and an attachment rider 820 in the track 810 said rider free to traverse the length of track 810 but preferably being captive in the track. One end of a flexible cable 310*a* is attached to the rider on the first float while the other end of the cable is attached either to a corresponding rider on the second float or to a fixed attachment point on the second float. The cable 310*a* has a predetermined length appropriate for tethering the two floats at a distance approximately the user's natural stance, although this length can easily be made adjustable by proper design of the attachment interface at rider 820. When the floats slide by each other, the rider on the first float is dragged in the direction of the second float whilst the rider on the second float (if both floats be so equipped) is dragged in the direction of the first float, thereby allowing the cable to continually define a maximum float separation. Preferably, each float is equipped with two riders and tethering cables, one near the bow and the other near the stern, such that the floats are held substantially parallel when they are at their maximum allowed separation. Additionally, it is preferable that the range over which each rider is permitted to travel is limited to half the expected stride so as to keep the riders at their respective ends of the floats.

It will be understood by the skilled artisan that the goals of this invention may be also be accomplished by using three or more attachments points for one or more cables, the additional cables being at the aforesaid ankle height or at different heights.

Float Kits

The inventor has realized that consumers or retailers may wish to buy unassembled floats that can be easily assembled. The advantage is that the consumer or retailers can assemble the floats to have a desired length or other characteristic based on the parts that are used for assembling the floats. Thus, the invention provides a kit for producing a float for floatation and transportation on water for a user. The kit may comprise two or more modular members sized to fit together to form a buoyant float. Preferably the modular members can be attached without tools, such as mating Velcro strips located on two mating modular members, or through a snap mechanism that can hold the modular members together. Preferably, the modular members will be assembled into a float having a sculpted hull 101 and covered by a top surface 104, as described above. More preferably, the kit will contain modular members to assemble two floats 100, one for the right foot, and one for the left foot of a user. Preferably, the kit further comprises an attachment point for a tether at the approximate predicted height of the user's ankle in the float.

Propulsion Mechanism

Figure 10:
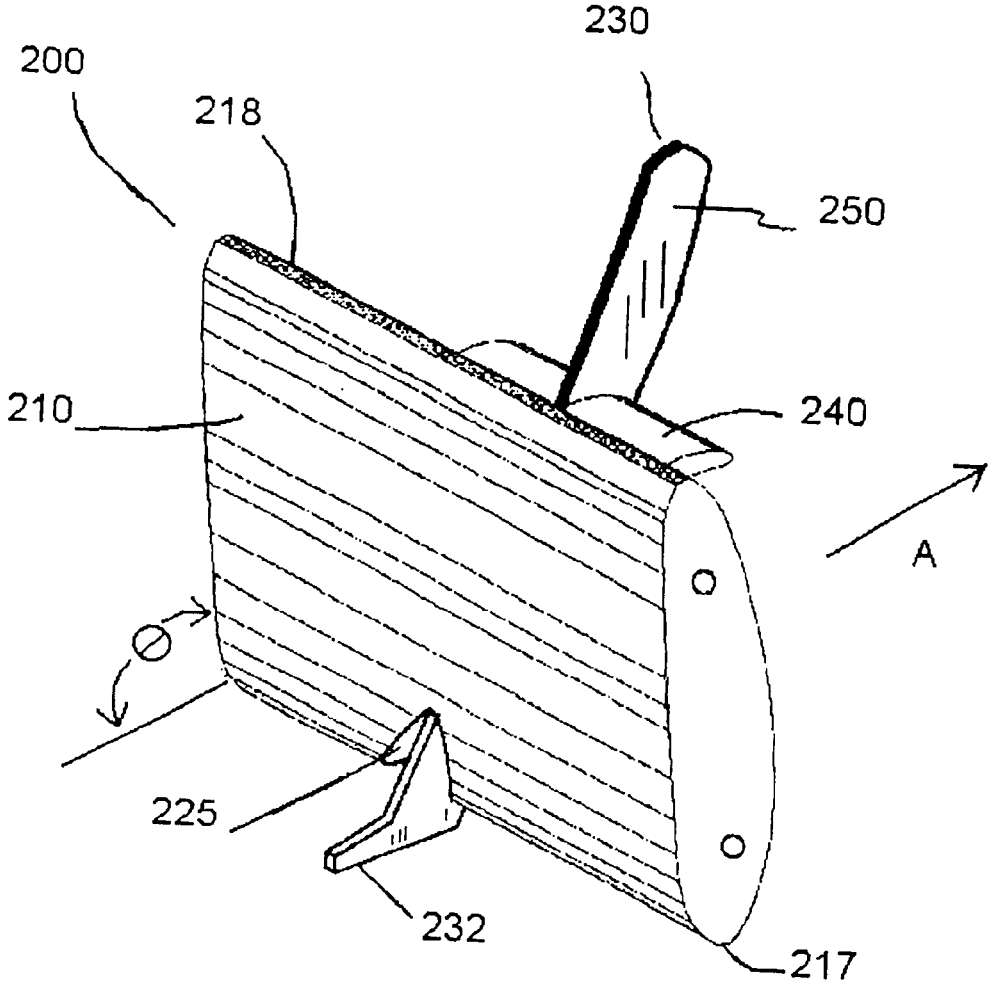
FIG. 10 illustrates one embodiment of a propulsion mechanism built according to the invention in its high resistance orientation.
Figure 11:
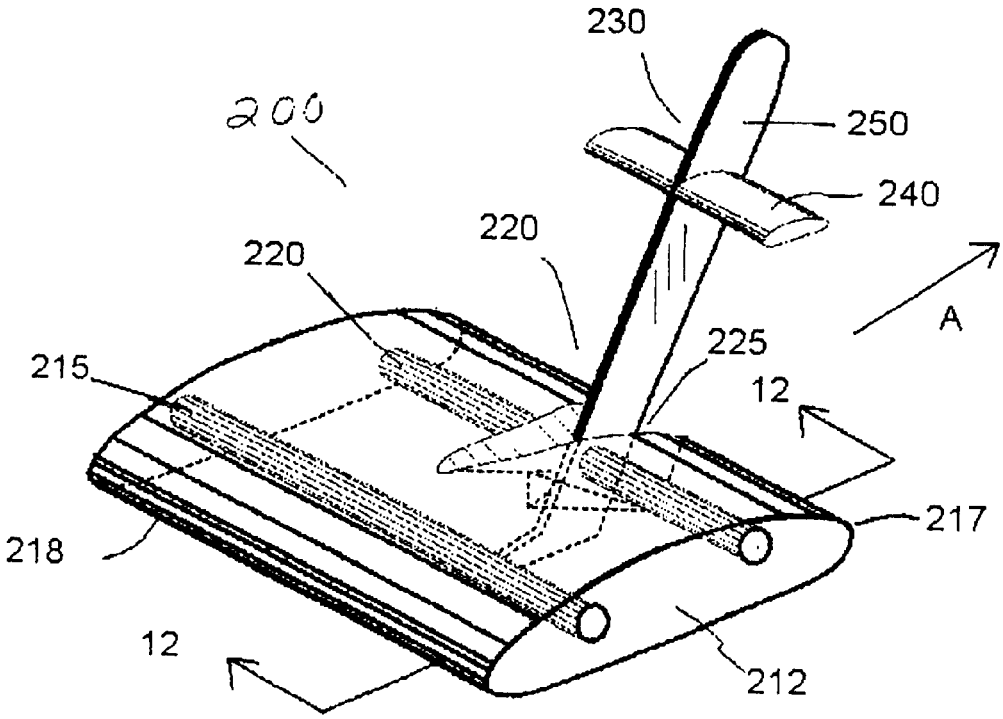
FIG. 11 illustrates the propulsion mechanism of FIG. 10 in its low resistance orientation.

Although floats 100 may be used by themselves for activities such as river skiing or float water skiing, more typically a propulsion mechanism is attached to allow the user to move without external assistance. Preferably, the propulsive mechanism is adapted for water walking or skating. FIG. 10 and FIG. 11 illustrates a preferred embodiment of a stroking propulsive mechanism suitable for water walking or skating. The propulsive mechanism 200 preferably comprises a rotatable flap 210, the flap attached to a flap support structure 230 by an articulation 220, said articulation enabling rotation of the flap. In other embodiments, more than one flap may be used, each flap attached to flap support 230 by its own articulation with enough of an offset to not significantly overlap ("shadow") any other flap. The flaps are normally (i.e., when "at rest") oriented in a vertical plane that is perpendicular to the direction of travel, said orientation being the high resistance orientation, but can easily rotate into a plane that contains the direction of travel, said orientation being the low resistance orientation. The articulation is preferably located near one edge of the flap, that edge being the edge at the bottom of the flap when the flap is in the high resistance orientation. Most preferably, the articulation point is located within the first 25% of the width of the flap, as measured from the leading edge to the trailing edge. In this configuration the other edge of the flap sweeps out a semi-cylindrical volume behind the flap support structure. In one preferred embodiment a mechanical rotation limiting mechanism is added that limits the flap from rotating significantly beyond the low resistance orientation; with this addition, the flap sweeps out only the approximate quarter-cylindrical volume behind the support structure and above the articulation axis. Consider just one of the typical pair of floats during a Forward, gliding step; the force of the water on the front face of the rotatable flaps causes the flaps to rotate rearward into their low resistance orientation. At the end of the Forward step the forward motion of the float is slowed and the user's weight is shifted onto this float; as the weight shifts, the float sinks lower in the water and the rotatable flap is rotated upwards by the (relatively) upward motion of the surrounding water. Preferably, the flap is made of a material that makes the flap slightly buoyant. This slight buoyancy adds an upwardly rotating torque to the torque generated by said upward water motion. By the time the user has shifted his weight fully onto this float and is ready to start the rearward push of the power step, the rotatable flap is in its high resistance orientation. During the rearward push, when the water pressure on the flap presses it relatively forward, the flap is prevented from further rotation primarily by the flap support acting as a stop.

The articulation rotation axis is perpendicular to the direction of travel, and preferably oriented within 45 degrees of the horizontal. More preferably, the articulation rotation axis is within 30 degrees of the horizontal, more preferably within 20 degrees of the horizontal, and most preferably within 10 degrees of the horizontal. The flap is preferably buoyant so, in the absence of other forces, it rotates about the articulation rotation axis, floating upward toward the vertical plane that is perpendicular to the direction of travel, until it is preferably restrained by a rotation limiting mechanism. The rotation axis and the rotation limiting mechanism are arranged such that the flap can only rotate towards the aft of the float. When a lateral force is applied to the vertical flap from the bow of the float, as is the case when the float is moved forward through water, the flap rotates about its pivot into a nearly horizontal plane, reducing its resistance to any water flowing past it. When a lateral force is applied to the vertical flap from the stern of the float, as is the case when the user pushes the float backwards during walking, the flap is simply pressed more tightly against the stop, creating significant resistance to any water trying to flow past it.

Figure 12:
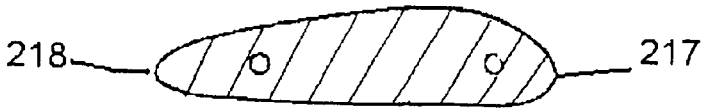
FIG. 12 is a sectional view of a flap from the propulsion mechanism of FIG. 10 taken at the sectioning plane and in the direction indicated by the line 12—12.

FIG. 10 shows the flap in the high resistance orientation and FIG. 11 shows the flap in the low resistance orientation. Generally, it is desirable to use flaps whose effective area (that is, the silhouette of all flaps on one float, as viewed into the direction of motion) has a small perimeter to area ratio, as such flaps are fluid dynamically most efficient. While a circular shape provides the such smallest ratio, a circular flap is non-optimal when all design considerations are included. Therefore, each flap 210 is a generally flat, rectangular solid comprising a length, a width, and a thickness, wherein the thickness is substantially smaller than either the length or the width and wherein the length and width of the effective shape are preferably equal (that is, the effective shape is a square). Preferably, as illustrated in FIG. 12, the generally rectangular cross section of each individual flap 210 is modified to be what is generally understood to be streamlined in the direction that flows through the water, and additionally modified to be smoothly varying at all corners. Additionally, flap 210 has a leading edge 217 and trailing edge 218, each of which may be sculpted to provide fluid dynamic advantage (not illustrated), said leading and trailing edges being respectively the edges that face generally into and away from the direction of travel when the flap is in the low resistance orientation.

Typically, flap 210 is fabricated from a lightweight and strong material, said material being compatible with the expected aquatic and solar ultraviolet environment. Wood, fiberglass, aluminum and some plastics are suitable materials. The flap may be unitary (e.g., solid), a filled shell (e.g., foam filled plastic shell), or a hollow shell. Flap 210 is preferably buoyant, and the inventor has determined that said buoyancy need only be enough to maintain flap 210 in the high resistance orientation (viz., upward) in fresh water in the absence of any lateral forces.

The size of flap 210 is determined by the required propulsive force. In terrestrial walking, the frictional force between the foot and the floor provides the reaction force needed to propel the walker forward; during water walking it is the resistance of these flaps to movement through the water that provides the reaction force. To permit a user to walk naturally on water, the propulsion mechanism should provide nearly 100% resistance to backward foot motion (simulating the no-slip behavior of terrestrial friction). Since the resistance of a flap moving through water is equal to the product of the applied force times the flap's fluid dynamic cross-section, said cross-section being a function of the effective shape of the flap and a factor to account for the flow of water around the edges of the flap, it is possible to estimate the flap area required to push a user of a certain mass forward through the water at a given speed and on any given float hull (the more streamlined the hull, the easier it is to move forward). Although said estimate could be made analytically for any given application, the inventor has determined experimentally that a total flap area of 90 square inches is typically adequate for many recreational activities for a 200 pound adult. Again, it should be noted that specialized activities may require larger or smaller flap areas to optimize performance and that such specialization is anticipated by the inventor.

Returning to the embodiment of FIGS. 10 and 11, each flap is articulated, preferably, at a pivot, said pivot preferably located parallel to and close to one of the rectangle's two longest edges, said edge becoming the leading edge 217 and said pivot being adapted to permit the flap to rotate between the high resistance, generally vertical, orientation and the low resistance, preferably horizontal, orientation. Preferably this rotation is limited to substantially 90 degrees, as indicated by the angle Θ in FIG. 10, said angle being in the rearward direction. Rotation beyond this limit only reduces the effectiveness of the flap and increases the time required to complete the rotation.

The pivot can be implemented in a variety of well know ways. For example, as shown in FIGS. 10 and 11, the pivot can be implemented by a metal pivot rod 220 inserted through a side panel 212 of flap, traversing flap 210 as close to edge 217 as the material strength of flap 210 will allow, and reaching substantially all the way to the opposing side panel. The pivot rod 220 also passes through a bearing hole (not illustrated) in the flap support 230. Not only does rod 220 provide the axle for the flap 210, it also reinforces flap 210 against the large pressure forces that are developed during each propulsion stroke. Optionally, flap 210 may also have a reinforcing rod 215 positioned parallel to pivot rod 220 and located generally near trailing edge 218. FIG. 12 illustrates another example of propulsion mechanism 200*a* in which pivot rod 220 extends beyond the side panels of flap 210 and is supported by two pivot bearing holes 235, said holes being located at the two ends of rod 220. It will be appreciated that the desired pivot function could equally be provided by installing two or more pivot points on flap support 230, said points matching with pivot bearings installed into flap 210. Similarly, it will be appreciated that a pivot mechanism that allows flap 210 to be removed and reinstalled without tools may be advantageously utilized to permit field repair or adaptation of the propulsion mechanism. Finally, it will be appreciated that a pivot is only one of the many ways to implement the desired rotational movement of this articulation.

Each flap 210 is attached to flap support structure 230. Support structure 230 comprises one or more support elements 250 which form the interface between the object being propelled (not illustrated) and the one or more flaps 210. Support structure 230 is thus preferably adapted for attachment to a water craft or other object that is being propelled. Preferably support element 250 is a generally elongated bar. That is, support element 250 has three dimensions, that is, a length, a width, and a thickness, wherein the length preferably runs generally vertically, the width is the dimension parallel to the direction of travel, and the thickness is the remaining dimension. The length of the support elements is selected to maintain all of said attached flaps below water when the flaps are in their high resistance orientation. Since support element 250 should transmit the full reaction force between the flaps 210 and the item being propelled, the element's width to thickness ratio is somewhat greater than unity in keeping with good engineering practice to ensure adequate bending strength. In some embodiments the element's width is increased, turning the support element into a fin-like attachment. Additionally, the support thickness is minimized and its cross-section in the horizontal plane is preferably streamlined to minimize fluid dynamic drag as the propulsion mechanism moves through the water.

Preferably, support element 250 has a support toe 232 that provides two functions. First, when support element 250 is generally vertical and the propulsion system is in shallow water or in the presence of underwater obstacles, toe 232 provides a contact point with the ground or obstacle, thereby protecting flap 210 from damage and providing a point against which the user may continue to push. Second, said toe acts as a downside stop for flap 210, preventing it from rotating beyond the horizontal position.

In order to generate power during the Backwards step, the propulsion mechanism 200 is designed to prevent flap 210 from rotating substantially forward from the high resistance position. During the Backwards step the flap should be substantially perpendicular to the direction of propulsion to provide high resistance to motion through the water. Preferably, flap support structure 230 includes a rotation limiting mechanism such as a flap rotation stop 240 against which flap 210 presses during the Backward step. In the example embodiment illustrated in FIG. 10 and FIG. 11 stop 240 is a generally horizontal, elongated, flat bar, similar in construction to support structure element 250 whose length corresponds generally to the width of flap 210. Stop 240 distributes the pressure over the width of flap 210. Preferably, stop 240 contacts flap 210 in the general location of reinforcing rod 215, if present. In designs in which two or more flaps are included the bottom edge of each upper flap can function as the stop for the next lower flap. The rotation limiting mechanism may also be located on the water craft which is being propelled by propulsion mechanism 200, in a position allowing flap 210 to come in contact with the rotation limiting mechanism to prevent flap 210 from rotating toward the bow beyond a position substantially perpendicular to the direction of travel.

Figure 13:
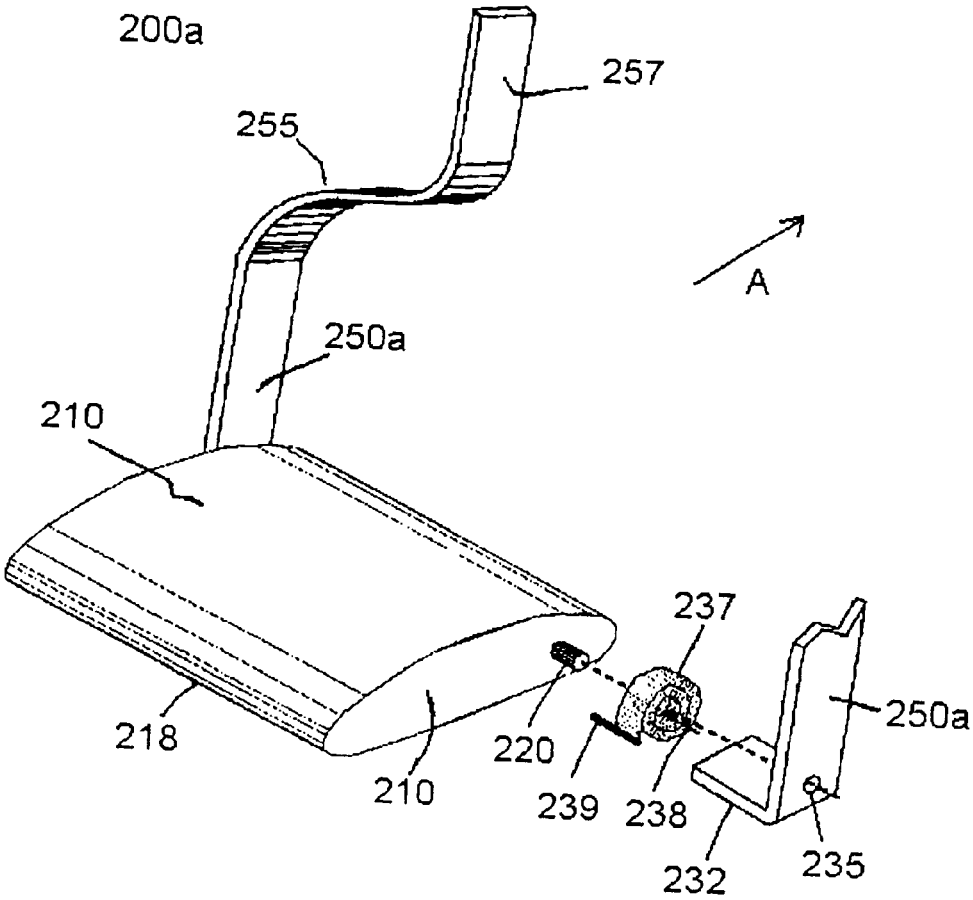
FIG. 13 is a partially exploded view of a second preferred embodiment of the propulsion mechanism built according to the invention, as positioned during a gliding or forward step.

A second embodiment of support structure 230, illustrated in FIG. 13, uses two support structure bar elements 250*a*, one running down each side of flaps 210. Each element 250*a* comprises a straight section to which flaps 210 will be articulated, a curved section 255, and an interface section 257. Since elements 250*a* are used in pairs they are either identical (but installed as right and left pairs with section 255 curved inwardly) or they have mirror symmetry about the vertical plane separating left and right. Interface section 257 is adapted to match propulsion mechanism 200*a* to a handle or other attachment mechanism. It may be noted that although the propulsion mechanisms 200 and 200*a* are illustrated with the pivot axis in the horizontal plane, said mechanisms are also adapted for use when rotated by 90 degrees about the direction of travel (arrow A), such rotation aligning the pivot axis in the vertical plane is advantageous when the propulsion mechanism is attached to the side of a floatation hull.

In the embodiment of FIG. 13, pivot rods 220 extends outwardly from each side panel 212 and enter matching pivot bearing holes 235 in the corresponding element 250*a*. In this embodiment there is no requirement for notch 225 which was illustrated in FIG. 11 to allow support element 250 to reach rod 220. Similarly there is no requirement for an explicit stop 240 since curved section 255 is located to contact flap 210 near trailing edge 218 when flap 210 is rotated to the high resistance orientation.

As has been described, flap 210 should rotate between the low resistance orientation and the high resistance orientation during the short duration between ending a Forward step and starting a Backward step. Additionally, the flap should be in the high resistance orientation whenever the user is not moving so that there is no slippage at the beginning of the user's first step. In the preferred embodiment, the flap 210 is buoyant and its articulation allows it to rotate about a horizontal axis, thereby "floating" into the high resistance orientation. In other embodiments of the propulsion mechanism flap 210 is not buoyant or rotates about a vertical axis. Preferably, these embodiments include a torque generation mechanism to rotate flap 210 into the high resistance orientation.

Figure 14:
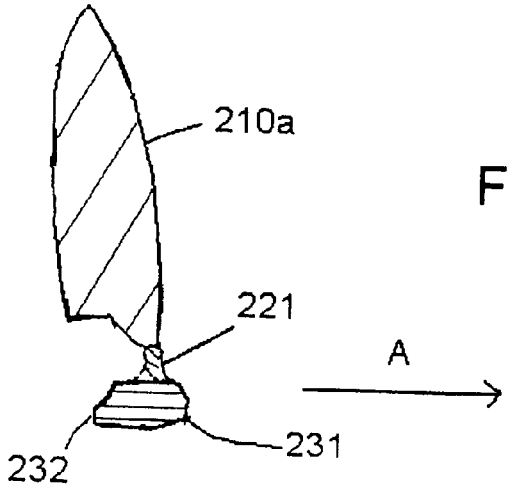
FIG. 14 illustrates a cross-section of a flap articulation that includes a torque generation mechanism.
Figure 15:
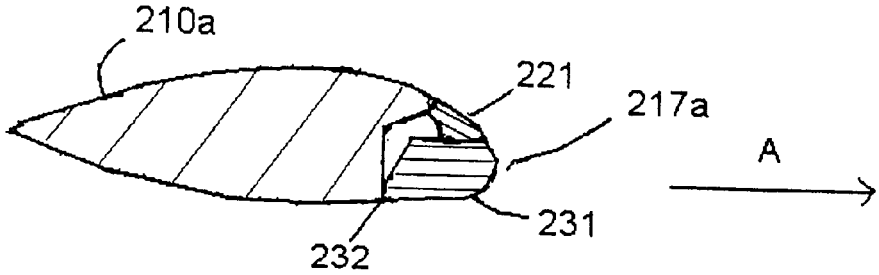
FIG. 15 illustrates the flap articulation of FIG. 14 in the low resistance orientation.

Generally, said torque generation mechanism includes force generated by a mechanical spring or resilient material, said spring or material being loaded when flap 210 is in the low resistance orientation and relaxed when flap 210 is in the high resistance orientation. In one embodiment, illustrated in FIG. 13, a simple, torque producing "watch spring" 237 is positioned over a protruding portion of pivot rod 220 and located between flap 210 and support element 250*a*. The spring has two tongues, an interior tongue 238 and an exterior tongue 239. Interior tongue 238 engages support element 250*a*, while exterior tongue presses upwards on flap 210, applying a torque tending to rotate the flap into the high resistance orientation. In another embodiment, FIGS. 14 and 15 are conceptual, cross-sectional illustrations of a torque generation mechanism in which a resilient material provides both the restoring torque and the connecting mechanism for flap 210*a*. The illustrated embodiment comprises three elements: a non-buoyant flap 210*a*, a fixed support bracket 231, and a resilient flexure 221. Conceptually, bracket 231 substitutes for the section of flap 210 near leading edge 217 and for the pivot rod 220, which were illustrated in FIG. 13; that is, bracket 231 is inserted between the two elements 250*a* at the locations defined by pivot holes 235. Bracket leading edge 217*a* replicates flap leading edge 217 when flap 210 is in the low resistance orientation. Flexure 221 connects flap 210*a* to bracket 231.

FIG. 14 shows this embodiment in the high resistance orientation. Flexure 221 is shown in its natural (viz., unstressed) shape. Flexure 221 is a shaped strip of natural or synthetic rubber or other elastic material attached to both bracket 231 and flap 210*a*, said strip running the full length of said flap. Alternatively, flexure 221 may be segmented into a number of shorter strips, generally equally spaced along bracket 231, wherein the total length of elastic material has been selected to provide a predetermined restoring torque. FIG. 15 illustrates this embodiment in the low resistance orientation. Flap 210*a* is rotated into this position by the lateral force of the water when the propulsion mechanism is moved forward (in the direction indicated by arrow A). The aforesaid predetermined restoring torque is significantly less than the torque generated by said lateral force, generally on the order of 10% of said water produced torque, to enable the forward walking step to proceed unimpeded. As illustrated, flap 210*a* rotates into the low resistance orientation and restricted from further rotation by a surface 232 on bracket 231. Said surface prevents flexure 221 from becoming overstressed by any upwards motion of bracket 231 (and relatively downward motion of the surrounding water on flap 210*a*) during the forward step.

As is well know in the mechanical design art, there are many alternative embodiments of a resilient or spring-like restoring torque. Referring to the propulsion mechanism of FIG. 13, the desired restoring force is provided by inserting any of the several available spring-like elements to operate between one or both support elements 250*a* and the flaps 210. The example, torsional "watch spring" element 237 being but one. It will be obvious to one skilled in the mechanical design art that there are many types of springs and many locations where they can be attached; for example, a suitable torque is generated by an elastic material stretched between the flap and the bottom or stern of a water craft. The inventor anticipates that many functionally equivalents can be used to suitable advantage.

In yet other embodiments the attachment location of propulsion mechanism 200 may be on the bottom or to the sides of the floats, more than one propulsion mechanism may be attached to each float, or the flaps may be incorporated inside a channel or tunnel running the length of each float.

Propulsion Mechanism Retraction Interface

As illustrated in FIG. 1, the propulsion mechanism 200 is preferably attached to the stern 150 of float 100 at the specifically designated attachment fixture 500, although there are alternative attachment locations, such as on outward facing side 103 or on the bottom of bottom side 105.

In a basic approach, propulsion mechanism 200 is rigidly attached to float 100 by a bracket interface between the fixture 500 on the float and support element 250 of the propulsion mechanism. Preferably, however, the attachment approach provides a retraction mechanism, operable both manually and automatically, to increase user mobility (viz., the transition between land, shallow water, and deep water) and to protect the propulsion mechanism from lateral impacts or horizontal surface contact.

FIG. 16 illustrates one embodiment of a propulsion mechanism retraction interface 502 attached to a water craft. Primarily, the interface pivotally attaches the propulsion mechanism to the stern of the float, using a spring to hold the mechanism in its normal, generally vertical, operating position. When the float is in shallow water, on land, or passes over an underwater obstacle some part of the propulsion mechanism, preferably toe 232, makes contact with a solid object. When contact is made, the support structure experiences strong rearward and/or upward forces, both of which impede forward motion and upset user stability if they are transferred to the float. Therefore, retraction interface 502 is adapted to absorb, rather than transmit, these forces by allowing propulsion mechanism 200 to rotate upwards against a restoring spring.

In one embodiment the retraction interface 502 comprises a pivot bracket 510 that can be attached to the float or water craft and into which the support element 250 is assembled, a fixed anchor point 530 mountable on the top surface 104 of the float or water craft, and a retention spring 520 connected between the fixed anchor and the support element 250. Support element 250 is nominally free to rotate about a pivot axis 515 on pivot bracket 510, the range of said rotation being approximately 90 degrees. The support element can rotate from the generally vertical operational orientation wherein flap 210 is at least partially immersed in the water to the generally horizontal, not operational, orientation when it is substantially retracted from the water.

Retention spring 520 is attached at one end at an attachment point 522 provided for that purpose on support element 250 and at the other end to anchor point 530, the relaxed length of the spring being slightly less than the minimum separation of said two points. Point 522 is located on support element 250 between pivot point 515 and toe 232 such that the tension of spring 520 operates to rotate support element 230 into the operational orientation with flap 210 at least partially under water. The support rotates until it makes contact with float 100 at the bottom of a generally "U" or "V" shaped positioning guide 570 installed at the stern 150 of float 100, said guide keeping support element 250 from becoming misaligned in a side-to-side direction. Preferably pivot point 515 is forward of the bottom of guide 570 such that the operating orientation of support element 250 is actually tilted slightly forward, said tilt being generally in the range of 5 to 10 degrees off of vertical. Said forward tilt ensures that a purely vertical force on toe 232, as occurs when weight is applied to float 100 in shallow water and the propulsion mechanism is pressed into the bottom, is converted into a torque about pivot 515, said torque acting to rotate the propulsion mechanism upwards without damage.

Interface 502 is also manually operable by applying a forward and downward force on the upper end of support element 250, said force rotating the propulsion mechanism into the horizontal, storage orientation. Generally interface 502 is provided with a latching mechanism to hold the propulsion mechanism in the storage orientation. FIG. 16 illustrates a latching mechanism comprising a retention cord 540 and a snap clasp 542, said cord attached at one end to the top of support element 250 and at the other end to the snap clasp 542. Snap clasp 542 is used to removably attach retention cord 540 to anchor 530. The length of the retention cord is selected to hold the propulsion mechanism in the storage orientation when clasp 542 is attached to anchor 530. FIG. 16 also illustrates an anti-tangle strap 545 and a strap loop 547, said strap and loop keeping retention cord 540 and clasp 542 from becoming entangled with the retraction interface when not in use.

Foot Powered Oar

As has been described, the propulsion mechanism 200 and the float 100 may be adapted for many different aquatic applications. For example, a single float with a foot power adaptation of the propulsion mechanism can be used as a water scooter. In riding a scooter the user maintains his weight substantially on one foot, said foot riding on the low-friction scooter, while repeatedly pushing backwards against the ground on the other foot. In riding the water scooter the user maintains his weight substantially on one foot on the one float while repeatedly propelling himself by operating a foot-powered paddling mechanism, or oar, said oar being an adaptation of the propulsion mechanism of FIG. 13.

Figure 17:
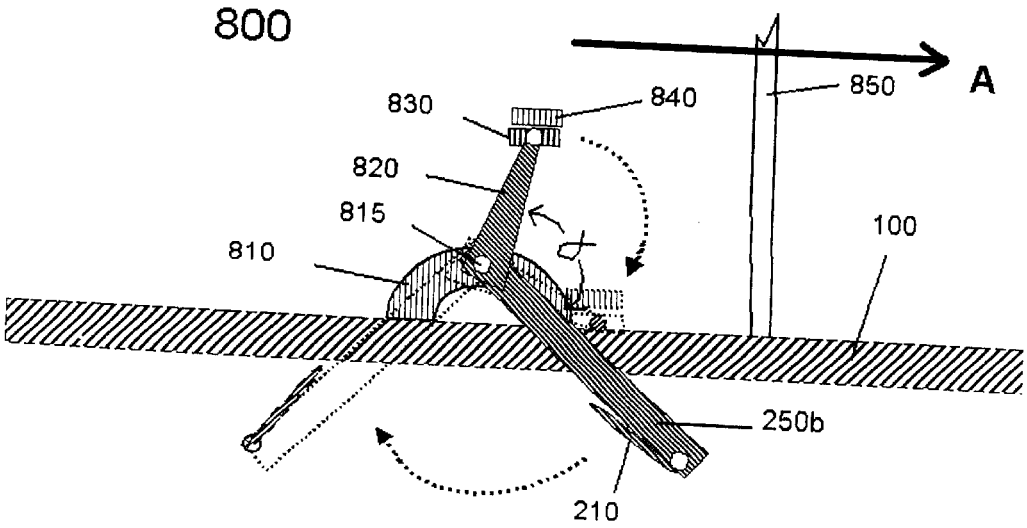
FIG. 17 is schematic view of the propulsion mechanism operating as a foot-powered oar during a power stoke.

As illustrated in the schematic side view of FIG. 17, the oar 800 comprises a foot pedal 830, a pedal crank 820 and a propulsion mechanism substantially identical to the previously described propulsion mechanism and comprising a flap 210 articulated to a support structure **250*b*. Oar 800 rotates on a horizontal pivot axis 815 attached to the float 100 by an pivot support bracket 810. In another embodiment, the flap is buoyant and the axis of rotation is within 45 degrees of horizontal, preferably within 30 degrees of horizontal, more preferably within 20 degrees of horizontal, and most preferably within 10 degrees of horizontal. In the scooter application, where only one float is used, float 100** preferably has left-right symmetry.

The pivot support bracket 810 is typically located at one edge of float 100, slightly aft of the center line. The pivot axis 815 is perpendicular to the direction of propulsion and parallel to the surface of the water. Support structure **250*b* is typically asymmetric, holding flap 210 under the float even though structure 250*b* should pass around the edge of the float to reach pivot axis 815. Pedal crank 820 and support structure 250*b* are joined at pivot axis 815, said join being made at an angle "$\alpha$". Angle "$\alpha$" is selected so, with support structure 250*b* at its forward most point, pedal 830, at the opposite end of crank 820 from pivot axis 815, is raised above the top surface 104 of float 100 and crank 820 is rotated forward of vertical about pivot axis 815**. The aforesaid forward rotation should be between 10 and 90 degrees, preferably between 20 and 70 degrees, more preferably 30 degrees.

Typically, the user's foot is engaged a foot bracket 840 on pedal 830. By stepping downward on pedal 830, the user rotates support structure **250*b* rearward for a power stroke. By removing the pressure on pedal 830, the user allows a pedal return spring (not illustrated) to rotate support structure 250*b*** back to the forward, starting position during a recovery stroke.

Figure 18:
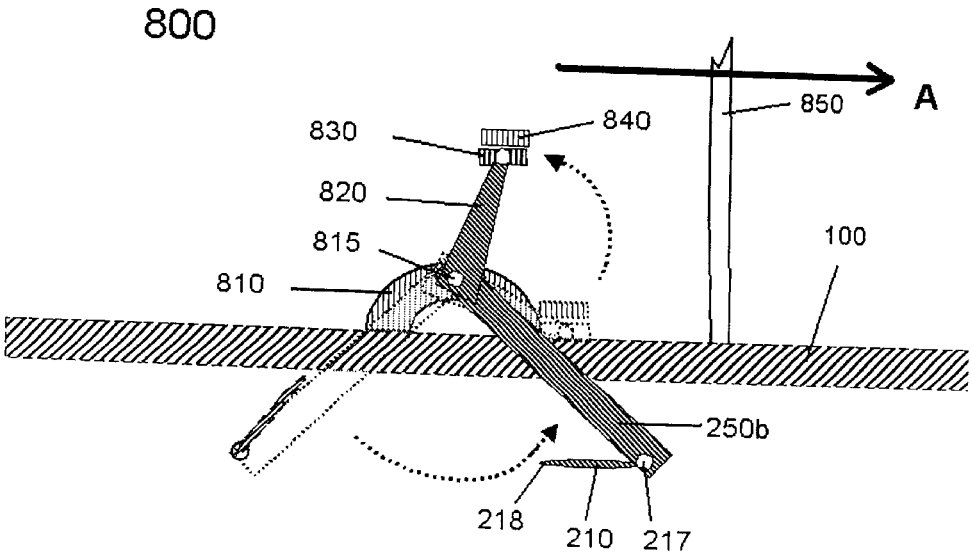
FIG. 18 is schematic view of the foot-powered oar during a return stoke.

Functioning in a manner described previously, flap 210 rotates between a high resistance and a low resistance orientation as the support structure alternates between rearward and forward rotations. FIG. 17 illustrates the high resistance orientation as it occurs at the beginning of a power stroke while FIG. 18 illustrates the low resistance orientation during the recovery stroke. The flap has a leading edge 217, a trailing edge 218, a width between said leading edge and trailing edge and an articulation point located within the first 25% of said width as measured from said leading edge; the flap is joined to the support element by an articulation that has an axis of rotation that is substantially perpendicular to direction of movement, said flap being movable substantially in rotation about said axis said rotation being in a semi-cylindrical space behind said axis, said space being away from said direction of travel.

Typically, a water scooter will also include a supporting handlebar 850 to provide the user with something to hold while stepping on pedal 830. This handlebar can advantageously be connected through float 100 to a rudder mechanism (not illustrated) by which steering can be effected. Further, a water scooter typically will have a fixed, direction stabilizing fin located under the stern.

Other embodiments of the foot-powered oar 800 are possible. For example, a ratcheted and/or gearing mechanism can be implemented between crank 820 and structure 250*b*, said mechanism reducing the angular motion of pedal 800 required to drive structure 250*b* through its full range and/or allowing different rates of return for the pedal and the structure. In another embodiment structure 250*b* can be made straight, rather than offset, with the attachment end of support structure 250*b* passing through a slot in float 100. In yet another adaptation, oars 800 can be used in matched pairs, left and right handed, thus appearing like a pair of duck feet underneath float 100. Said paired usage allows steering by differential propulsion. A final alternative adaptation changes the angle "$\alpha$" so that the useful arc of pedal 830 is adapted for a user sitting in a recumbent cycling position.

Preferably, the invention further comprises a rotation limiting mechanism situated on one of said support structure or said flap for preventing the flap from rotating beyond a position substantially perpendicular to said direction of movement.

While this invention has been described in conjunction with the specific embodiments outlined above, many alternatives, modifications and variations will be apparent to those skilled in the art. Accordingly, the preferred embodiments of the invention as set forth above are intended to be illustrative, and not limiting. Various changes may be made without departing from the spirit and scope of the invention as defined in the following claims.

What I claim as my invention is:

1. An apparatus to be worn on the feet of a user for the purpose of floatation and transportation on water in a direction of travel, comprising:

a first buoyant float and a second buoyant float, each of said first buoyant float and said second buoyant float comprising a center of buoyancy, a bow, and a stern, and further comprising:

a sculpted hull, said sculpted hull comprising:

a substantially straight and generally flat inward side running from said bow to said stern;

a substantially convex outward side having convexity, a top edge and a bottom edge, said substantially convex outward side and said convexity running from said bow to said stern, and said convexity being away from the direction of said substantially straight and generally flat inward side, said substantially convex outward side additionally being farther from said substantially straight and generally flat inward side at said top edge than at said bottom edge;

a bottom side in watertight connection with said substantially straight and generally flat inward side and said substantially convex outward side, wherein said substantially straight and generally flat inward side, said substantially convex outward side, and said bottom side form a smooth and continuous exterior surface; and a top surface covering said sculpted hull;

a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy, wherein said substantially convex outward side and the substantially straight and generally flat inward side act cooperatively to form an aerofoil whereby said sculpted hull experiences a force in the direction generally from said substantially straight and generally flat inward side to said substantially convex outward side when moving in the direction of travel in water; and a support structure attached to one of said first buoyant float or said second buoyant float; and a buoyant flap comprising a leading edge, a trailing edge, a width between said leading edge and trailing edge and an articulation located within the first 25% of said width as measured from said leading edge, said buoyant flap articulated to said support structure at said articulation, said articulation having an axis of rotation that is both within 45 degrees of horizontal and substantially perpendicular to said direction of travel, said buoyant flap being movable substantially in rotation about said axis, said rotation being in a space behind said axis, said space being away from said direction of travel.

2. An apparatus to be worn on the feet of a user for the purpose of floatation and transportation on water in a direction of travel, comprising:

a first buoyant float and a second buoyant float, each of said first buoyant float and said second buoyant float comprising a center of buoyancy, a bow, and a stern, and further comprising:

a sculpted hull, said sculpted hull comprising:

a substantially straight and generally flat inward side running from said bow to said stern;

a substantially convex outward side having convexity, a top edge and a bottom edge, said substantially convex outward side and said convexity running from said bow to said stern, and said convexity being away from the direction of said substantially straight and generally flat inward side, said substantially convex outward side additionally being farther from said substantially straight and generally flat inward side at said top edge than at said bottom edge;

a bottom side in watertight connection with said substantially straight and generally flat inward side and said substantially convex outward side, wherein said substantially straight and generally flat inward side, said substantially convex outward side, and said bottom side form a smooth and continuous exterior surface; and a top surface covering said sculpted hull;

a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy, wherein said substantially convex outward side and the substantially straight and generally flat inward side act cooperatively to form an aerofoil whereby said sculpted hull experiences a force in the direction generally from said substantially straight and generally flat inward side to said substantially convex outward side when moving in the direction of travel in water; and a support structure attached to one of said first buoyant float or said second buoyant float; and a flap comprising a leading edge, a trailing edge, a width between said leading edge and trailing edge and an articulation located within the first 25% of said width as measured from said leading edge, said flap articulated to said support structure at said articulation, said articulation having an axis of rotation that is both within 45 degrees of horizontal and substantially perpendicular to said direction, said flap being movable substantially in rotation about said axis, said rotation being in a space behind said axis, said space being away from said direction of travel and generally between a plane parallel to and a plane perpendicular to the direction of travel.

3. An apparatus to be worn on the feet of a user for the purpose of floatation and transportation on water in a direction of travel, comprising:

a first buoyant float and a second buoyant float, each of said first buoyant float and said second buoyant float comprising a center of buoyancy, a bow, and a stern, and further comprising:

a sculpted hull, said sculpted hull comprising:

a substantially straight and generally flat inward side running from said bow to said stern;

a substantially convex outward side having convexity, a top edge and a bottom edge, said substantially convex outward side and said convexity running from said bow to said stern, and said convexity being away from the direction of said substantially straight and generally flat inward side, said substantially convex outward side additionally being farther from said substantially straight and generally flat inward side at said top edge than at said bottom edge;

a bottom side in watertight connection with said substantially straight and generally flat inward side and said substantially convex outward side, wherein said substantially straight and generally flat inward side, said substantially convex outward side, and said bottom side form a smooth and continuous exterior surface; and a top surface covering said sculpted hull;

a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy, wherein said substantially convex outward side and the substantially straight and generally flat inward side act cooperatively to form an aerofoil whereby said sculpted hull experiences a force in the direction generally from said substantially straight and generally flat inward side to said substantially convex outward side when moving in the direction of travel in water; and a support structure attached to one of said first buoyant float or said second buoyant float;

a flap comprising a leading edge, a trailing edge, a width between said leading edge and trailing edge and an articulation located within the first 25% of said width as measured from said leading edge, said flap articulated to said support structure at said articulation, said articulation having an axis of rotation that is substantially perpendicular to said direction, said flap being movable substantially in rotation about said axis, said rotation being in a space behind said axis, said space being away from said direction of travel; and a torque generating mechanism connected between said flap and said support structure, said mechanism comprising a stressed material exerting torque on said flap, said torque directed so as to rotate said flap toward a position substantially perpendicular to said direction, said torque being exerted on said flap at all rotation positions of said flap.

* * * * *

UNITED STATES PATENT AND TRADEMARK OFFICE

CERTIFICATE OF CORRECTION

PATENT NO. : 6,764,363 B2
DATED : July 20, 2004
INVENTOR(S) : Yoav Rosen

It is certified that error appears in the above-identified patent and that said Letters Patent is hereby corrected as shown below:

Columns 23-25,
Delete claims 1-3, and replace with the following:

1. An apparatus to be worn on the feet of a user for the purpose of floatation and transportation on water in a direction of travel, comprising:

a first buoyant float and a second buoyant float, each of said first buoyant float and said second buoyant float comprising a center of buoyancy, a bow, and a stern, and further comprising:

a sculpted hull, said sculpted hull comprising:

a substantially straight and generally flat inward side running from said bow to said stern;

a substantially convex outward side having convexity, a top edge and a bottom edge, said substantially convex outward side and said convexity running from said bow to said stern, and said convexity being away from the direction of said substantially straight and generally flat inward side, said substantially convex outward side additionally being farther from said substantially straight and generally flat inward side at said top edge than at said bottom edge;

a bottom side in watertight connection with said substantially straight and generally flat inward side and said substantially convex outward side, wherein said substantially straight and generally flat inward side, said substantially convex outward side, and said bottom side form a smooth and continuous exterior surface; and a top surface covering said sculpted hull;

a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy, It is certified that error appears in the above-identified patent and that said Letters Patent is hereby corrected as shown below:

Columns 23-25, cont'd., wherein said substantially convex outward side and the substantially straight and generally flat inward side act cooperatively to form an aerofoil whereby said sculpted hull experiences a force in the direction generally from said substantially straight and generally flat inward side to said substantially convex outward side when moving in the direction of travel in water; and a support structure attached to one of said first buoyant float or said second buoyant float; and a buoyant flap comprising a leading edge, a trailing edge, a width between said leading edge and trailing edge and an articulation located within the first 25% of said width as measured from said leading edge, said buoyant flap articulated to said support structure at said articulation, said articulation having an axis of rotation that is both within 45 degrees of horizontal and substantially perpendicular to said direction of travel, said buoyant flap being movable substantially in rotation about said axis, said rotation being in a space behind said axis, said space being away from said direction of travel.

2. An apparatus to be worn on the feet of a user for the purpose of floatation and transportation on water in a direction of travel, comprising:

a first buoyant float and a second buoyant float, each of said first buoyant float and said second buoyant float comprising a center of buoyancy, a bow, and a stern, and further comprising:

a sculpted hull, said sculpted hull comprising:

a substantially straight and generally flat inward side running from said bow to said stern;

a substantially convex outward side having convexity, a top edge and a bottom edge, said substantially convex outward side and said convexity running from said bow to said stern, and said convexity being away from the direction of said substantially straight and generally flat inward side, said substantially convex outward side additionally being farther from said substantially straight and generally flat inward side at said top edge than at said bottom edge;

a bottom side in watertight connection with said substantially straight and generally flat inward side and said substantially convex outward side, wherein said substantially straight and generally flat inward side, said substantially convex outward side, and said bottom side form a smooth It is certified that error appears in the above-identified patent and that said Letters Patent is hereby corrected as shown below:

Columns 23-25, cont'd., and continuous exterior surface; and a top surface covering said sculpted hull;

a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy, wherein said substantially convex outward side and the substantially straight and generally flat inward side act cooperatively to form an aerofoil whereby said sculpted hull experiences a force in the direction generally from said substantially straight and generally flat inward side to said substantially convex outward side when moving in the direction of travel in water; and a support structure attached to one of said first buoyant float or said second buoyant float; and a flap comprising a leading edge, a trailing edge, a width between said leading edge and trailing edge and an articulation located within the first 25% of said width as measured from said leading edge, said flap articulated to said support structure at said articulation, said articulation having an axis of rotation that is both within 45 degrees of horizontal and substantially perpendicular to said direction, said flap being movable substantially in rotation about said axis, said rotation being in a space behind said axis, said space being away from said direction of travel and generally between a plane parallel to and a plane perpendicular to the direction of travel.

3. An apparatus to be worn on the feet of a user for the purpose of floatation and transportation on water in a direction of travel, comprising:

a first buoyant float and a second buoyant float, each of said first buoyant float and said second buoyant float comprising a center of buoyancy, a bow, and a stern, and further comprising:

a sculpted hull, said sculpted hull comprising:

a substantially straight and generally flat inward side running from said bow to said stern;

It is certified that error appears in the above-identified patent and that said Letters Patent is hereby corrected as shown below:

Columns 23-25, cont'd., a substantially convex outward side having convexity, a top edge and a bottom edge, said substantially convex outward side and said convexity running from said bow to said stern, and said convexity being away from the direction of said substantially straight and generally flat inward side, said substantially convex outward side additionally being farther from said substantially straight and generally flat inward side at said top edge than at said bottom edge;

a bottom side in watertight connection with said substantially straight and generally flat inward side and said substantially convex outward side, wherein said substantially straight and generally flat inward side, said substantially convex outward side, and said bottom side form a smooth and continuous exterior surface; and a top surface covering said sculpted hull;

a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy, wherein said substantially convex outward side and the substantially straight and generally flat inward side act cooperatively to form an aerofoil whereby said sculpted hull experiences a force in the direction generally from said substantially straight and generally flat inward side to said substantially convex outward side when moving in the direction of travel in water; and a support structure attached to one of said first buoyant float or said second buoyant float;

a flap comprising a leading edge, a trailing edge, a width between said leading edge and trailing edge and an articulation located within the first 25% of said width as measured from said leading edge, said flap articulated to said support structure at said articulation, said articulation having an axis of rotation that is substantially perpendicular to said direction, said flap being movable substantially in rotation about said axis, said rotation being in a space behind said axis, said space being away from said direction of travel; and a torque generating mechanism connected between said flap and said support structure, said mechanism comprising a stressed material exerting torque on said flap, said torque directed so as to rotate said flap toward a position substantially perpendicular to said

UNITED STATES PATENT AND TRADEMARK OFFICE

CERTIFICATE OF CORRECTION

PATENT NO. : 6,764,363 B2
DATED : July 20, 2004
INVENTOR(S) : Yoav Rosen

It is certified that error appears in the above-identified patent and that said Letters Patent is hereby corrected as shown below:

Columns 23-25, cont'd., direction, said torque being exerted on said flap at all rotation positions of said flap.

Signed and Sealed this

Ninth Day of November, 2004

JON W. DUDAS
*Director of the United States Patent and Trademark Office*

UNITED STATES PATENT AND TRADEMARK OFFICE

CERTIFICATE OF CORRECTION

PATENT NO. : 6,764,363 B2
DATED : July 20, 2004
INVENTOR(S) : Yoav Rosen

It is certified that error appears in the above-identified patent and that said Letters Patent is hereby corrected as shown below:

Columns 23-26,
Delete claims 1-3, and replace with the following:

1. An apparatus to be worn on the feet of a user for the purpose of floatation and transportation on water in a direction of travel, comprising:

a first buoyant float and a second buoyant float, each of said first buoyant float and said second buoyant float comprising a center of buoyancy, a bow, and a stern, and further comprising:

a sculpted hull, said sculpted hull comprising:

a substantially straight and generally flat inward side running from said bow to said stern;

a substantially convex outward side having convexity, a top edge and a bottom edge, said substantially convex outward side and said convexity running from said bow to said stern, and said convexity being away from the direction of said substantially straight and generally flat inward side, said substantially convex outward side additionally being farther from said substantially straight and generally flat inward side at said top edge than at said bottom edge;

a bottom side in watertight connection with said substantially straight and generally flat inward side and said substantially convex outward side, wherein said substantially straight and generally flat inward side, said substantially convex outward side, and said bottom side form a smooth and continuous exterior surface; and a top surface covering said sculpted hull;

a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy, It is certified that error appears in the above-identified patent and that said Letters Patent is hereby corrected as shown below:

Columns 23-26 (cont'd), wherein said substantially convex outward side and the substantially straight and generally flat inward side act cooperatively to form an aerofoil whereby said sculpted hull experiences a force in the direction generally from said substantially straight and generally flat inward side to said substantially convex outward side when moving in the direction of travel in water; and a support structure attached to one of said first buoyant float or said second buoyant float; and a buoyant flap comprising a leading edge, a trailing edge, a width between said leading edge and trailing edge and an articulation located within the first 25% of said width as measured from said leading edge, said buoyant flap articulated to said support structure at said articulation, said articulation having an axis of rotation that is both within 45 degrees of horizontal and substantially perpendicular to said direction of travel, said buoyant flap being movable substantially in rotation about said axis, said rotation being in a space behind said axis, said space being away from said direction of travel.

2. An apparatus to be worn on the feet of a user for the purpose of floatation and transportation on water in a direction of travel, comprising:

a first buoyant float and a second buoyant float, each of said first buoyant float and said second buoyant float comprising a center of buoyancy, a bow, and a stern, and further comprising:

a sculpted hull, said sculpted hull comprising:

a substantially straight and generally flat inward side running from said bow to said stern;

a substantially convex outward side having convexity, a top edge and a bottom edge, said substantially convex outward side and said convexity running from said bow to said stern, and said convexity being away from the direction of said substantially straight and generally flat inward side, said substantially convex outward side additionally being farther from said substantially straight and generally flat inward side at said top edge than at said bottom edge;

a bottom side in watertight connection with said substantially straight and generally flat inward side and said substantially convex outward side, wherein said substantially straight and generally flat inward side, said substantially convex outward side, and said bottom side form a smooth It is certified that error appears in the above-identified patent and that said Letters Patent is hereby corrected as shown below:

Columns 23-26 (cont'd), and continuous exterior surface; and a top surface covering said sculpted hull;

a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy, wherein said substantially convex outward side and the substantially straight and generally flat inward side act cooperatively to form an aerofoil whereby said sculpted hull experiences a force in the direction generally from said substantially straight and generally flat inward side to said substantially convex outward side when moving in the direction of travel in water; and a support structure attached to one of said first buoyant float or said second buoyant float; and a flap comprising a leading edge, a trailing edge, a width between said leading edge and trailing edge and an articulation located within the first 25% of said width as measured from said leading edge, said flap articulated to said support structure at said articulation, said articulation having an axis of rotation that is both within 45 degrees of horizontal and substantially perpendicular to said direction, said flap being movable substantially in rotation about said axis, said rotation being in a space behind said axis, said space being away from said direction of travel and generally between a plane parallel to and a plane perpendicular to the direction of travel.

3. An apparatus to be worn on the feet of a user for the purpose of floatation and transportation on water in a direction of travel, comprising:

a first buoyant float and a second buoyant float, each of said first buoyant float and said second buoyant float comprising a center of buoyancy, a bow, and a stern, and further comprising:

a sculpted hull, said sculpted hull comprising:

a substantially straight and generally flat inward side running from said bow to said stern;

It is certified that error appears in the above-identified patent and that said Letters Patent is hereby corrected as shown below:

Columns 23-26 (cont'd), a substantially convex outward side having convexity, a top edge and a bottom edge, said substantially convex outward side and said convexity running from said bow to said stern, and said convexity being away from the direction of said substantially straight and generally flat inward side, said substantially convex outward side additionally being farther from said substantially straight and generally flat inward side at said top edge than at said bottom edge;

a bottom side in watertight connection with said substantially straight and generally flat inward side and said substantially convex outward side, wherein said substantially straight and generally flat inward side, said substantially convex outward side, and said bottom side form a smooth and continuous exterior surface; and a top surface covering said sculpted hull;

a foot well for housing said user's foot and ankle, said foot well disposed through said top surface of said buoyant float and extending toward said bottom side, said foot well further located to position said user's ankle substantially in vertical alignment with the center of buoyancy, and said foot well further comprising a bottom surface that is below said center of buoyancy, wherein said substantially convex outward side and the substantially straight and generally flat inward side act cooperatively to form an aerofoil whereby said sculpted hull experiences a force in the direction generally from said substantially straight and generally flat inward side to said substantially convex outward side when moving in the direction of travel in water; and a support structure attached to one of said first buoyant float or said second buoyant float;

a flap comprising a leading edge, a trailing edge, a width between said leading edge and trailing edge and an articulation located within the first 25% of said width as measured from said leading edge, said flap articulated to said support structure at said articulation, said articulation having an axis of rotation that is substantially perpendicular to said direction, said flap being movable substantially in rotation about said axis, said rotation being in a space behind said axis, said space being away from said direction of travel; and a torque generating mechanism connected between said flap and said support structure, said mechanism comprising a stressed material exerting torque on said flap, said torque directed so as to rotate said flap toward a position substantially perpendicular to said

UNITED STATES PATENT AND TRADEMARK OFFICE

CERTIFICATE OF CORRECTION

PATENT NO. : 6,764,363 B2
DATED : July 20, 2004
INVENTOR(S) : Yoav Rosen

It is certified that error appears in the above-identified patent and that said Letters Patent is hereby corrected as shown below:

Columns 23-26 (cont'd), direction, said torque being exerted on said flap at all rotation positions of said flap.

This certificate supersedes Certificate of Correction issued November 9, 2004.

Signed and Sealed this

Eleventh Day of April, 2006

JON W. DUDAS
*Director of the United States Patent and Trademark Office*